US009811016B2

(12) United States Patent
Aoki et al.

(10) Patent No.: US 9,811,016 B2
(45) Date of Patent: Nov. 7, 2017

(54) TONER

(71) Applicant: CANON KABUSHIKI KAISHA, Tokyo (JP)

(72) Inventors: Kenji Aoki, Mishima (JP); Tetsuya Kinumatsu, Mishima (JP); Yusuke Kosaki, Susono (JP); Shuntaro Watanabe, Hadano (JP); Noritaka Toyoizumi, Mishima (JP); Takaaki Kaya, Suntou-gun (JP); Atsushi Tani, Suntou-gun (JP); Takashige Kasuya, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/071,981

(22) Filed: Mar. 16, 2016

(65) Prior Publication Data

US 2016/0282740 A1 Sep. 29, 2016

(30) Foreign Application Priority Data

Mar. 25, 2015 (JP) ..... 2015-062986

(51) Int. Cl.
*G03G 9/087* (2006.01)
*G03G 9/093* (2006.01)
*G03G 9/08* (2006.01)

(52) U.S. Cl.
CPC ..... *G03G 9/09371* (2013.01); *G03G 9/0821* (2013.01); *G03G 9/08755* (2013.01)

(58) Field of Classification Search
CPC ..... G03G 9/08788
See application file for complete search history.

(56) References Cited

U.S. PATENT DOCUMENTS 5,840,457 A 11/1998 Urawa et al.
6,300,024 B1 10/2001 Yusa et al.
(Continued)

FOREIGN PATENT DOCUMENTS

JP 2007-33773 A 2/2007
JP 2012-42939 A 3/2012
(Continued)

OTHER PUBLICATIONS

Inumatsu, et al., U.S. Appl. No. 15/073,572, filed Mar. 17, 2016.

*Primary Examiner* — Hoa V Le
(74) *Attorney, Agent, or Firm* — Fitzpatrick Cella Harper and Scinto

(57) ABSTRACT

A toner comprising a toner particle comprising a binder resin that comprises a crystalline resin, wherein the toner satisfies the following formulas (1) and (2) in DSC measurement of the toner, $$50.0 \leq Tt \leq 80.0 \quad \text{formula (1)}$$

$$0.00 \leq \Delta H_{T't-3}/\Delta H \leq 0.20 \quad \text{formula (2)}$$

where
Tt [° C.] is the peak temperature of the endothermic peak $P_1$, ΔH [J/g] is the endothermic quantity from a temperature lower than T't by 20.0° C. to a temperature higher than T't by 10.0° C. when T't [° C.] is the peak temperature of the endothermic peak $P_2$, and $\Delta H_{T't-3}$ [J/g] is the endothermic quantity from a temperature lower than T't by 20.0° C. to a temperature lower than T't by 3.0° C.

11 Claims, 2 Drawing Sheets

(56) References Cited

U.S. PATENT DOCUMENTS

| | | | | |
|---|---|---|---|---|
| 8,460,845 | B2 | 6/2013 | Kaya et al. | |
| 8,465,896 | B2 | 6/2013 | Sekikawa et al. | |
| 8,475,987 | B2 | 7/2013 | Kaya et al. | |
| 8,497,056 | B2 | 7/2013 | Sekikawa et al. | |
| 8,551,680 | B2 | 10/2013 | Ayaki et al. | |
| 8,741,519 | B2 | 6/2014 | Watanabe et al. | |
| 9,116,449 | B2 | 8/2015 | Sakamoto et al. | |
| 2009/0291383 | A1 | 11/2009 | Ayaki et al. | |
| 2010/0035171 | A1 | 2/2010 | Watanabe et al. | |
| 2013/0130169 | A1* | 5/2013 | Aoki | G03G 9/08755 430/109.4 |
| 2013/0323637 | A1* | 12/2013 | Watanabe | G03G 9/0802 430/109.4 |
| 2014/0220486 | A1 | 8/2014 | Kaya et al. | |
| 2014/0349232 | A1* | 11/2014 | Kinumatsu | G03G 9/0804 430/137.14 |
| 2014/0356777 | A1* | 12/2014 | Tani | G03G 9/09321 430/108.3 |
| 2016/0002396 | A1 | 1/2016 | Ida et al. | |

FOREIGN PATENT DOCUMENTS

| | | | |
|---|---|---|---|
| JP | 2014-186278 | A | 10/2014 |
| JP | 2014-218654 | A | 11/2014 |
| JP | 2015-36723 | A | 2/2015 |

* cited by examiner

TONER

BACKGROUND OF THE INVENTION

Field of the Invention

The present invention relates to a toner used in electrophotographic methods, static recording methods, and toner jet recording methods.

Description of the Related Art

Reducing energy consumption has in recent years also been regarded as a major technical problem for electrophotographic devices, and significant reductions in the amount of heat required by the fixing apparatus have thus been investigated. Accordingly, there is increasing need for the toner to be capable of undergoing fixing at lower energies, i.e., for "low-temperature fixability". In addition, the medium that has been subjected to fixing is frequently also placed in a severe environment, e.g., high temperatures and/or high humidities, and as a result it is also crucial with regard to the toner that medium-to-medium adhesion not occur even when storage in a severe environment is carried out (heat-resistant storability).

In order to improve the low-temperature fixability and heat-resistant storability of toners, the method of incorporating a crystalline resin in the binder resin has been investigated in recent years. The amorphous resins generally used as binder resins for toners do not exhibit a clear endothermic peak in measurement with a differential scanning calorimeter (DSC), but when they contain a crystalline resin component an endothermic peak caused by the melting point is seen in the DSC measurement. Due to the regular arrangement of their molecular chains, crystalline resins undergo almost no softening at temperatures below the melting point, while at higher temperatures bounded by the melting point the crystals abruptly melt and an abrupt decline in the viscosity occurs in association with this. As a consequence, they are receiving attention as materials that have an excellent sharp melt property and that combine heat-resistant storability with low-temperature fixability.

However, crystalline resins are high molecular weight materials, and, due to the occurrence of scatter in their molecular weight, molecular chains are produced that do not undergo regular arrangement. Thus, it is known that a tail ends up being produced on the low-temperature side of the endothermic peak due primarily to a low molecular weight component. This causes a lowering of the heat-resistant storability of the toner, and as a consequence measures have been taken to raise the crystallinity in the toner.

Japanese Patent Application Laid-open No. 2012-042939 provides a toner in which the crystallinity of the crystalline resin in the toner particle has been raised by the execution, after toner particle production, of a heat treatment at a specific temperature lower than the melting point of the crystalline resin, i.e., an annealing treatment. The heat-resistant storability is improved by doing this.

SUMMARY OF THE INVENTION

Investigations by the present inventors, on the other hand, made it clear that, once fixing has been carried out, the effects of the toner annealing treatment described in Japanese Patent Application Laid-open No. 2012-042939 are not reflected by the crystalline resin component on the medium. The reason for this is as follows: even though the crystallinity is raised by the annealing treatment, the crystallinity ends up being degraded when the toner is melted under the application of heat during fixing. It was thus found that when the fixed image was stored at high temperatures, there was a risk that medium-to-medium adhesion would occur.

Thus, a problem was still present with regard to the ability of the low-temperature fixability to co-exist in good balance with the stability of the fixed image in severe environments.

The present invention was achieved considering this issue and takes as its problem the introduction of a toner that exhibits an excellent stability by the fixed image in severe environments while also being a toner that exhibits an excellent low-temperature fixability.

The present invention relates to a toner comprising a toner particle comprising a binder resin, wherein the binder resin comprises a crystalline resin A, the toner satisfies the following formulas (1) and (2) in measurement of the toner with a differential scanning calorimeter (DSC), $$50.0 \leq Tt \leq 80.0 \quad \text{formula (1)}$$

$$0.00 \leq \Delta H_{T't-3}/\Delta H \leq 0.20 \quad \text{formula (2)}$$

in formulas (1) and (2),

Tt [° C.] represents the peak temperature of the endothermic peak $P_1$ originating from the crystalline resin A during a first temperature ramp up process;

ΔH [J/g] represents the endothermic quantity originating from the crystalline resin A from the temperature lower than T't by 20.0° C. to the temperature higher than T't by 10.0° C. when T't [° C.] is the peak temperature of the endothermic peak $P_2$ originating from the crystalline resin A during a second temperature ramp up process; and $\Delta H_{T't-3}$ [J/g] represents the endothermic quantity originating from the crystalline resin A from the temperature lower than T't by 20.0° C. to the temperature lower than T't by 3.0° C.

The present invention can provide a toner that exhibits an excellent stability by the fixed image in severe environments while also being a toner that exhibits an excellent low-temperature fixability.

Further features of the present invention will become apparent from the following description of exemplary embodiments (with reference to the attached drawings).

DESCRIPTION OF THE EMBODIMENTS

Figure 1:
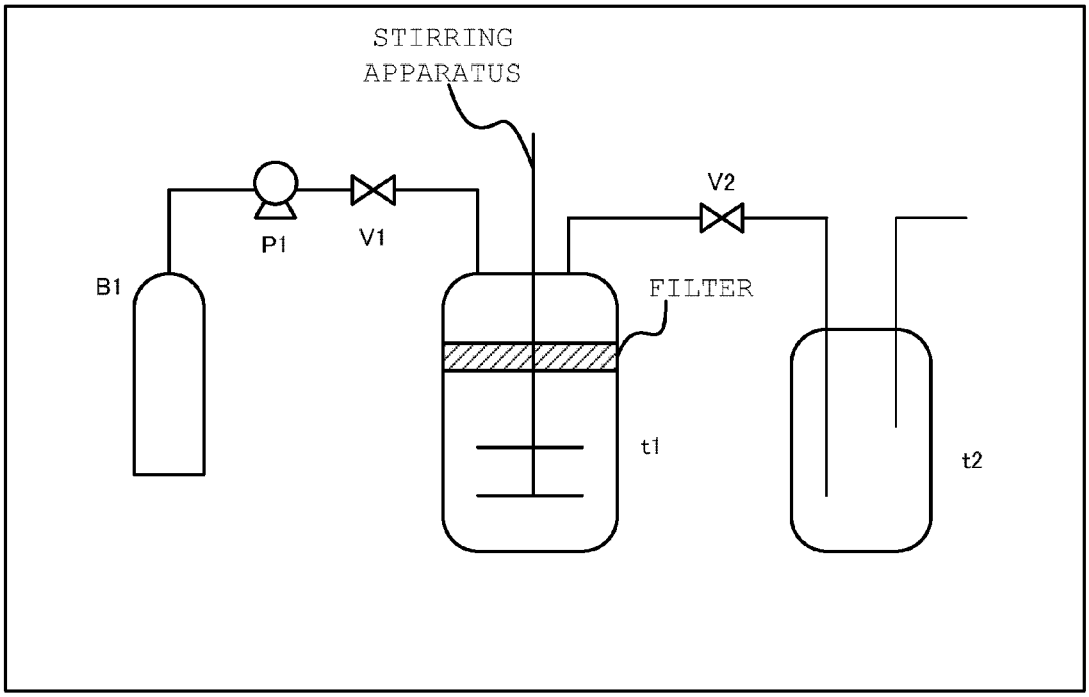
FIG. 1 is a schematic diagram that shows an example of an apparatus for producing the toner of the present invention.
Figure 2:
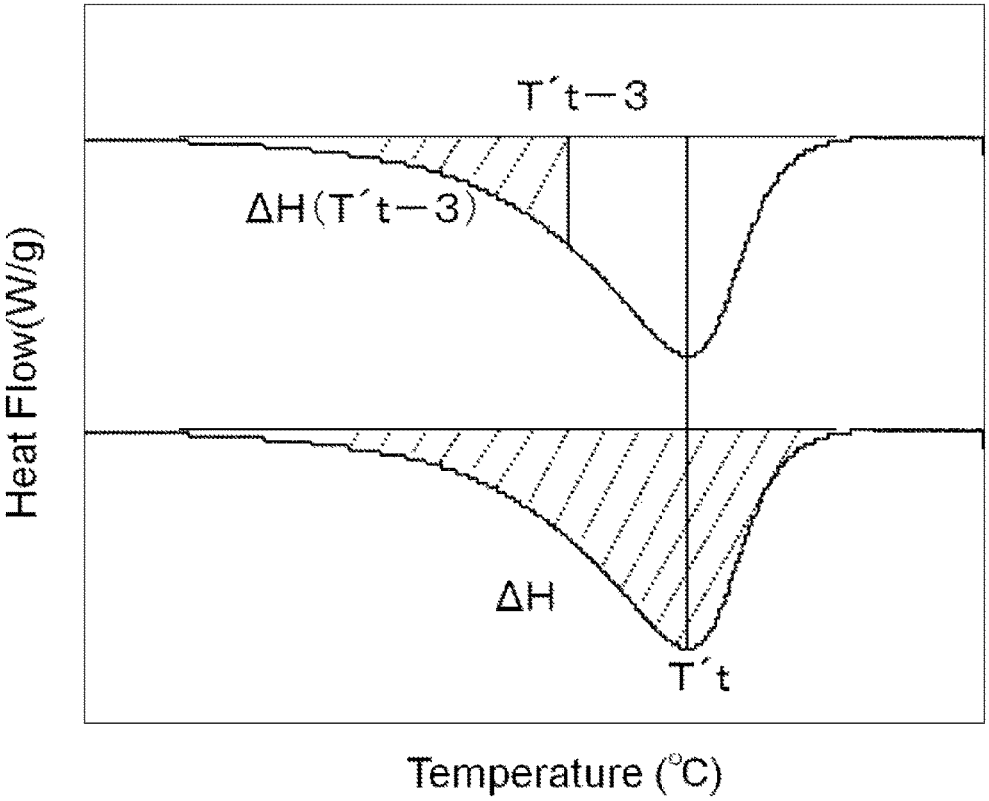
FIG. 2 is a conceptual diagram that shows ΔH and $\Delta H_{T't-3}$ for the toner of the present invention.

The toner of the present invention contains a binder resin that has a crystalline resin A. Here, the crystalline resin is a resin that has a structure in which high molecular weight molecular chains, when aggregated in large numbers, are regularly arranged. Such a resin exhibits a clear endothermic peak (melting point) in differential scanning calorimetric measurement using a differential scanning calorimeter (DSC).

The toner of the present invention satisfies the following formula (1) in measurement of the toner using a differential scanning calorimeter (DSC)

$$50.0 \leq Tt \leq 80.0 \quad \text{formula (1)}$$

(Tt (° C.) represents the peak temperature of the endothermic peak $P_1$ originating from the crystalline resin A during a first temperature ramp up process).

When Tt is lower than 50.0° C., this is advantageous for the low-temperature fixability, but lowers the stability of the fixed image in severe environments. When, on the other hand, Tt is higher than 80.0° C., the low-temperature fixability then undergoes a decline. From 55.0° C. to 70.0° C. is preferred.

The toner of the present invention satisfies the following formula (2) in measurement of the toner with a DSC.

$$0.00 \leq \Delta H_{T't\text{-}3}/\Delta H \leq 0.20 \quad \text{formula (2)}$$

($\Delta H$ (J/g) represents the endothermic quantity originating from the crystalline resin A from the temperature lower than T't by 20.0° C. to the temperature higher than T't by 10.0° C. where T't (° C.) is the peak temperature of the endothermic peak $P_2$ originating from the crystalline resin A during a second temperature ramp up process. $\Delta H_{T't\text{-}3}$ (J/g) represents the endothermic quantity originating from the crystalline resin A from the temperature lower than T't by 20.0° C. to the temperature lower than T't by 3.0° C.)

The crystalline resin A-containing binder resin is macromolecular and is influenced by its low-molecular weight component and low-crystallinity component. Accordingly, this is not a situation in which a completely regular structure is assumed, and the endothermic peak in measurement with a DSC has a tail on the low-temperature side and has a certain temperature width. Due to this, even in the case of a resin having a favorable Tt, a lowering of the heat-resistant storability is produced due to the occurrence of softening due to the influence of the component that induces the tail on the low-temperature side.

With the objective of improving the heat-resistant storability of toners, a large number of measures for raising the crystallinity of toners, e.g., by annealing and so forth, have been carried out to date. On the other hand, it is known that the post-fixing toner, since it has undergone a temporary interim melting, exhibits a loss of the effects of, for example, annealing and so forth, and thus exhibits a decline in crystallinity; however, no measures that raise the crystallinity of the post-fixing toner have been undertaken. As a result, when the fixed image has been subjected to long-term storage in a severe environment, the crystallinity has undergone a further decline and image-to-image adhesion has ultimately been produced due to a softening of the resin component on the image. The present inventors reached a solution to this problem by raising the crystallinity of the resin component in the fixed image.

$\Delta H$ represents the endothermic quantity originating from the crystalline resin A from the temperature lower than T't by 20.0° C. to the temperature higher than T't by 10.0° C.; however, since heat uptake is generally not observed at temperatures outside this temperature range, it substantially represents the total endothermic quantity originating from the crystalline resin A. In addition, $\Delta H_{T't\text{-}3}$ represents the endothermic quantity originating from the crystalline resin A from the component responsible for the tail on the low-temperature side, i.e., the low-crystallinity component.

Formula (2) is a property value in a second temperature ramp up process in measurement using a DSC. The second temperature ramp up process denotes the thermal properties of the toner after a temporary interim melting, i.e., the thermal properties of the toner components on the fixed image. Accordingly, by having $\Delta H_{T't\text{-}3}/\Delta H$ be in the range indicated above, there is little elaboration of the tail on the low-temperature side of the endothermic peak $P_2$ and as a result a fully satisfactory stability by the fixed image in severe environments can be obtained. $0.00 \leq \Delta H_{T't\text{-}3}/\Delta H \leq 0.15$ is more preferred.

Measures for raising the crystallinity of the post-melted toner are necessary in order to bring $\Delta H_{T't\text{-}3}/\Delta H$ into the appropriate range. Specific measures are described in the following, but there is no limitation to these.

The toner particle of the toner of the present invention is preferably a toner particle having a core-shell structure that composed of a core and a shell phase on a surface of the core. The core contains the binder resin and the shell phase contains a resin B. In addition, this resin B preferably contains a segment $b_1$ originating from a crystalline resin $B_1$ and a segment $b_2$ originating from a crystalline resin $B_2$. The binder resin and the crystalline resins $B_1$ and $B_2$ preferably satisfy the following formulas (4) and (5)

$$10.0 \leq TB_2 - TA \leq 30.0 \quad \text{formula (4)}$$

$$-10.0 \leq TA - TB_1 \leq 5.0 \quad \text{formula (5)}$$

(TA (° C.) represents the peak temperature of the endothermic peak originating from the crystalline resin A during the first temperature ramp up process in measurement of the binder resin using a DSC;

$TB_1$ (° C.) represents the peak temperature of the endothermic peak during the first temperature ramp up process in measurement of the crystalline resin $B_1$ with a DSC; and $TB_2$ (° C.) represents the peak temperature of the endothermic peak during the first temperature ramp up process in measurement of the crystalline resin $B_2$ with a DSC).

Raising the crystallinity exhibited by the crystalline resin A after its heating and melting due to fixing is crucial for improving the stability of the fixed image in severe environments. After the heating and melting, the segment $b_2$ originating from the crystalline resin $B_2$ crystallizes prior to the crystallization of the crystalline resin A. This results in the formation of crystal nuclei, and due to this the crystallization of the crystalline resin A after the aforementioned heating and melting is promoted and the crystallinity of the crystalline resin A after this heating and melting can be raised. Having $TB_2$-TA be in the range of formula (4) facilitates a suitable increase in the crystallinity of the crystalline resin A after the heating and melting and as a result facilitates improvement in the stability of the fixed image in severe environments.

In addition, the segment $b_1$ originating from the crystalline resin $B_1$ can bring about an increase in the effect of the segment $b_2$ originating from the crystalline resin $B_2$. The reason for this is thought to be as follows: the crystallization of the crystalline resin A is mediated by the presence in the shell phase of both the segment $b_1$ originating from the crystalline resin $B_1$ and the segment $b_2$ originating from the crystalline resin $B_2$. That is, with regard to the sequence of crystallization after the heating and melting, it is thought that the segment $b_2$ originating from the crystalline resin $B_2$ crystallizes first and that the crystalline resin A proceeds to crystallize at about the same time as the crystallization of the $b_1$ originating with the crystalline resin $B_1$. Having TA-$TB_1$ be in the indicated range facilitates the appearance of the mediating effect of the segment $b_2$ originating from the crystalline resin $B_2$ and thus facilitates improvement in the stability of the fixed image in severe environments.

A more preferred range for TA-$TB_1$ is from −5.0° C. to 5.0° C. In addition, a more preferred range for $TB_2$-TA is from 15.0° C. to 30.0° C.

$TB_1$ and $TB_2$ preferably also satisfy the following formula (6).

$$5.0 \leq TB_2 - TB_1 \leq 35.0 \quad \text{formula (6)}$$

An additional promotion of the crystallization of the crystalline resin A is facilitated by having $TB_2$-$TB_1$ be in the indicated range because the segment $b_1$ originating from the crystalline resin $B_1$ then crystallizes after a satisfactory development of the crystallization of the segment $b_2$ originating from the crystalline resin $B_2$. The result is the facilitation of additional improvements in the stability of the fixed image in severe environments. A more preferred range for $TB_2$-$TB_1$ is from 10.0° C. to 30.0° C. The peak temperature Tt of the aforementioned endothermic peak can be controlled through the composition and molecular weight of the crystalline resin A and the conditions under which the toner is produced. TA, $TB_1$, and $TB_2$ can be controlled through the composition and molecular weight of the crystalline resin A, the crystalline resin $B_1$, and the crystalline resin $B_2$ and through the conditions under which these resins are produced.

The resin B is described in the following. The crystalline resin $B_1$ and the crystalline resin $B_2$ constituting the resin B can be exemplified by crystalline vinyl resins, crystalline polyesters, crystalline polyurethanes, and crystalline polyureas, wherein crystalline polyesters are preferred.

This crystalline polyester is preferably a polyester resin obtained by the polycondensation of monomer that contains $C_{2-20}$ aliphatic diol and $C_{2-20}$ aliphatic dicarboxylic acid. In addition, this aliphatic diol and aliphatic dicarboxylic acid are preferably linear chain types.

Linear chain aliphatic diols suitably used in the present invention can be exemplified by the following, although there is no limitation to these and combinations may also be used depending on the case: ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol.

Linear chain aliphatic dicarboxylic acids suitably used in the present invention can be exemplified by the following, although there is no limitation to these and combinations may also be used depending on the case: oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, as well as the lower alkyl esters and anhydrides of the preceding.

There are no particular limitations on the method of producing this crystalline polyester, and it can be produced by general polyester polymerization methods in which the aforementioned diol monomer and dicarboxylic acid monomer are reacted. For example, production may be carried out by selecting direct polycondensation or a transesterification method as appropriate depending on the species of monomer.

The production of this crystalline polyester is preferably carried out between a polymerization temperature of 180° C. and 230° C., and the reaction is preferably run while removing the water and/or alcohol produced during condensation, as necessary with a reduction in pressure in the reaction system. When the monomer is not soluble or compatible at the reaction temperature, dissolution is advantageously brought about by the addition of a high-boiling solvent as a solubilizing agent. The polycondensation reaction is run while distilling out the solubilizing solvent. When a poorly compatible monomer is present in the copolymerization reaction, preferably the poorly compatible monomer is condensed in advance with an acid or alcohol planned for polycondensation with this monomer, followed by polycondensation together with the main component.

Catalysts that can be used in the production of this crystalline polyester can be exemplified by the following: titanium catalysts such as titanium tetraethoxide, titanium tetrapropoxide, titanium tetraisopropoxide, and titanium tetrabutoxide, and tin catalysts such as dibutyltin dichloride, dibutyltin oxide, and diphenyltin oxide.

The melting point of this crystalline polyester is preferably from 45.0° C. to 120.0° C. and, when melting at the fixation temperature is considered, from 50.0° C. to 100.0° C. is more preferred.

A crystalline polyester obtained by the polycondensation of monomer that includes a linear chain aliphatic diol and a linear chain aliphatic dicarboxylic acid is preferably used for the crystalline resin $B_1$ and the crystalline resin $B_2$. That is, the crystalline resin $B_1$ and the crystalline resin $B_2$ preferably contain a crystalline polyester that has a unit derived from a linear chain aliphatic diol and a unit derived from a linear chain aliphatic dicarboxylic acid. In this case the crystalline resin $B_1$ and the crystalline resin $B_2$ preferably satisfy the following formula (7). The number of carbons in the dicarboxylic acid also includes the carbons in the carboxyl groups.

$$Cb_2 - Cb_1 \geq 2.0 \qquad \text{formula (7)}$$

($Cb_1$ represents the total of the number of carbons in the linear chain aliphatic diol of the crystalline resin $B_1$ and the number of carbons in the linear chain aliphatic dicarboxylic acid of the crystalline resin $B_1$; and $Cb_2$ represents the total of the number of carbons in the linear chain aliphatic diol of the crystalline resin $B_2$ and the number of carbons in the linear chain aliphatic dicarboxylic acid of the crystalline resin $B_2$)

In addition, the total of the content of the linear chain aliphatic diol and the content of the linear chain aliphatic dicarboxylic acid in the total monomer used for these linear chain crystalline polyesters is preferably from 90.0 mass % to 100.0 mass %.

$Cb_1$ and $Cb_2$ are defined as follows when two or more linear chain aliphatic diols and when two or more linear chain aliphatic dicarboxylic acids are used.

$Cb_1$ or $Cb_2$=(number of carbons in a first linear chain aliphatic diol×mole fraction with respect to the diol monomer of the first linear chain aliphatic diol)+(number of carbons in a second linear chain aliphatic diol×mole fraction with respect to the diol monomer of the second linear chain aliphatic diol)+ . . . +(number of carbons in a first linear chain aliphatic dicarboxylic acid×mole fraction with respect to the dicarboxylic acid monomer of the first linear chain aliphatic dicarboxylic acid)+(number of carbons in a second linear chain aliphatic dicarboxylic acid×mole fraction with respect to the dicarboxylic acid monomer of the second linear chain aliphatic dicarboxylic acid)+ . . .

In the case of the co-use of a diol or dicarboxylic acid other than a linear chain aliphatic diol or a linear chain aliphatic dicarboxylic acid, the former are not taken into account in $Cb_1$ and $Cb_2$ as long as they are not more than 5.0 mass % with respect to the total monomer. $Cb_2$-$Cb_1$ is more preferably from 4.0 to 8.0.

Any procedure may be used with the toner of the present invention as the method for incorporating in the resin B the segment $b_1$ originating from the crystalline resin $B_1$ and the segment $b_2$ originating from the crystalline resin $B_2$. For example, in one method a polymerizable unsaturated group may be bonded to the segment $b_1$ and to the segment $b_2$ and copolymerization by radical polymerization may then be carried out with another vinylic monomer. Other methods include the method of obtaining a polyester by polycondensation with other diol monomer and other dicarboxylic acid monomer and the method of obtaining a polyurethane by polycondensation with other diisocyanate monomer and other diol monomer. Among the preceding, and viewed from the standpoint of the selectivity of the other monomer and ease of polymerization, the method is preferred in which a polymerizable unsaturated group is bonded to the segment $b_1$ and the segment $b_2$ and copolymerization by radical polymerization is then carried out with another vinylic monomer.

The method for adding a polymerizable unsaturated group to the segment $b_1$ and the segment $b_2$ can be exemplified by the following.

(1) Methods in which the polymerizable unsaturated group is introduced at the time of the polycondensation reaction between the dicarboxylic acid and diol. Methods for introducing this polymerizable unsaturated group can be exemplified by the following procedures.

(1-1) The method of using a polymerizable unsaturated group-bearing dicarboxylic acid for a portion of the dicarboxylic acid.

(1-2) The method of using a polymerizable unsaturated group-bearing diol for a portion of the diol.

(1-3) The method of using a polymerizable unsaturated group-bearing dicarboxylic acid and a polymerizable unsaturated group-bearing diol for, respectively, a portion of the dicarboxylic acid and a portion of the diol.

The degree of unsaturation of the polymerizable unsaturated group-bearing polyester can be adjusted through the amount of addition of the polymerizable unsaturated group-bearing dicarboxylic acid or diol.

The polymerizable unsaturated group-bearing dicarboxylic acid can be exemplified by fumaric acid, maleic acid, 3-hexenedioic acid, and 3-octenedioic acid. Additional examples are the lower alkyl esters and anhydrides of the preceding. Viewed from the standpoint of cost, fumaric acid and maleic acid are more preferred among the preceding. The polymerizable unsaturated group-bearing aliphatic diol can be exemplified by the following compounds: 2-butene-1,4-diol, 3-hexene-1,6-diol, and 4-octene-1,8-diol.

(2) Methods in which a vinylic compound is coupled with a polyester itself prepared by the polycondensation of dicarboxylic acid and diol.

This coupling may be a direct coupling of a vinylic compound that contains a functional group capable of reacting with a terminal functional group on the polyester. In addition, coupling may be carried out after the polyester terminal has been modified using a linker so as to enable reaction with a functional group carried by the vinylic compound. The following methods are examples.

(2-1) The method of carrying out a condensation reaction between a polyester having the carboxyl group in terminal position and a hydroxyl group-bearing vinylic compound.

In this case, the molar ratio between the dicarboxylic acid and diol (dicarboxylic acid/diol) in the preparation of the polyester is preferably from 1.02 to 1.20.

(2-2) The method of carrying out a urethanation reaction between a polyester having the hydroxyl group in terminal position and an isocyanate group-bearing vinylic compound.

(2-3) The method of carrying out a urethanation reaction of a polyester having the hydroxyl group in terminal position and a hydroxyl group-bearing vinylic compound with a diisocyanate functioning as a linker.

The molar ratio between the diol and the dicarboxylic acid (diol/dicarboxylic acid) in the preparation of the polyester used in methods (2-2) and (2-3) is preferably from 1.02 to 1.20.

The hydroxyl group-bearing vinylic compound can be exemplified by hydroxystyrene, N-methylolacrylamide, N-methylolmethacrylamide, hydroxyethyl acrylate, hydroxyethyl methacrylate, hydroxypropyl acrylate, hydroxypropyl methacrylate, polyethylene glycol monoacrylate, polyethylene glycol monomethacrylate, allyl alcohol, methallyl alcohol, crotyl alcohol, isocrotyl alcohol, 1-butene-3-ol, 2-butene-1-ol, 2-butene-1,4-diol, propargyl alcohol, 2-hydroxyethyl propenyl ether, and sucrose allyl ether. Hydroxyethyl acrylate and hydroxyethyl methacrylate are preferred among the preceding.

The isocyanate group-bearing vinylic compound can be exemplified by the following: 2-isocyanatoethyl acrylate, 2-isocyanatoethyl methacrylate, 2-(0-[1'-methylpropylideneamino]carboxyamino)ethyl methacrylate, 2-[(3,5-dimethylpyrazolyl)carbonylamino]ethyl methacrylate, and m-isopropenyl-α,α-dimethylbenzyl isocyanate. 2-isocyanatoethyl acrylate and 2-isocyanatoethyl methacrylate are particularly preferred among the preceding.

The diisocyanate can be exemplified by the following: aliphatic diisocyanates that have from 2 to 18 carbons (excluding the carbons in the NCO groups; this also applies in the following), alicyclic diisocyanates that have from 4 to 15 carbons, aromatic diisocyanates that have from 6 to 20 carbons, and modifications of these diisocyanates (modifications containing the urethane group, carbodiimide group, allophanate group, urea group, biuret group, uretdione group, uretonimine group, isocyanurate group, or oxazolidone group; also referred to hereafter as modified diisocyanates).

The aromatic diisocyanates can be exemplified by the following: m- and/or p-xylylene diisocyanate (XDI) and α,α,α',α'-tetramethylxylylene diisocyanate.

The aliphatic diisocyanates can be exemplified by the following: ethylene diisocyanate, tetramethylene diisocyanate, hexamethylene diisocyanate (HDI), and dodecamethylene diisocyanate.

The alicyclic diisocyanates can be exemplified by the following: isophorone diisocyanate (IPDI), dicyclohexylmethane-4,4'-diisocyanate, cyclohexylene diisocyanate, and methylcyclohexylene diisocyanate.

XDI, HDI, and IPDI are preferred among the preceding.

When a polymerizable unsaturated group is added to the segment $b_1$ and the segment $b_2$, with regard to the segment $b_1$ and the segment $b_2$ the average of the number of polymerizable unsaturated groups contained in a single molecule of the crystalline resin $B_1$ and the crystalline resin $B_2$ is preferably from 1.0 to 3.0. This average of the number of polymerizable unsaturated groups represents the degree of unsaturation of the aforementioned polymerizable unsaturated group-bearing polyester.

The resin B may be a resin that contains in its molecular structure the organopolysiloxane structure given by the following formula (i).

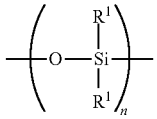

(i)

An organopolysiloxane structure is a structure in which the Si—O bond is a repeat unit and two alkyl groups are bonded to this Si. $R^1$ in formula (i) represents an alkyl group. The number of carbons in the alkyl group is preferably from 1 to 3 for each, and the number of carbons in $R^1$ is more preferably 1. In addition, n is the degree of polymerization and is preferably an integer from 2 to 133 and is more preferably an integer from 2 to 18.

The organopolysiloxane structure has a low interfacial tension and due to this facilitates a lowering of the adhesiveness of the fixed image when the fixed image has been held in a severe environment.

Methods for introducing this organopolysiloxane structure into the resin B by radical polymerization can be exemplified by a method in which the vinyl-modified organopolysiloxane compound given by formula (ii) below is added to the monomer composition along with the segment $b_1$ and the segment $b_2$ and carrying out polymerization. In formula (ii), $R^2$ and $R^3$ are alkyl groups (preferably having from 1 to 3 carbons); $R^4$ is an alkylene group (preferably having from 1 to 5 carbons); and $R^5$ is a hydrogen atom or a methyl group. n represents the degree of polymerization and is preferably an integer from 2 to 133 and is more preferably an integer from 2 to 18.

(ii)

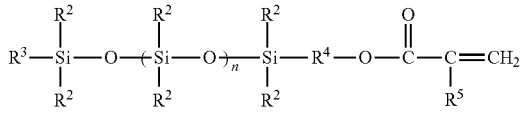

When a vinyl resin is used as the resin B, other vinylic monomer as follows may be used besides the monomers described above.

aliphatic vinyl hydrocarbons: alkenes, for example, ethylene, propylene, butene, isobutylene, pentene, heptene, diisobutylene, octene, dodecene, octadecene, and α-olefins other than the preceding; alkadienes, for example, butadiene, isoprene, 1,4-pentadiene, 1,5-hexadiene, 1,6-heptadiene, and 1,7-octadiene.

alicyclic vinyl hydrocarbons: mono- and di-cycloalkenes and -alkadienes, for example, cyclohexene, cyclopentadiene, vinylcyclohexene, and ethylidenebicycloheptene; terpenes, for example, pinene, limonene, and indene.

aromatic vinyl hydrocarbons: styrene and its hydrocarbyl (alkyl, cycloalkyl, aralkyl, and/or alkenyl)-substitution products, for example, α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene; and vinylnaphthalene.

carboxyl group-containing vinylic monomers and their metal salts: for example, carboxyl group-containing vinylic monomers such as $C_{3-30}$ unsaturated monocarboxylic acids, unsaturated dicarboxylic acids, and their anhydrides and monoalkyl ($C_{1-27}$) esters, e.g., acrylic acid, methacrylic acid, maleic acid, maleic anhydride, monoalkyl esters of maleic acid, fumaric acid, monoalkyl esters of fumaric acid, crotonic acid, itaconic acid, monoalkyl esters of itaconic acid, glycol monoether itaconate, citraconic acid, monoalkyl esters of citraconic acid, and cinnamic acid.

Vinyl esters, for example, vinyl acetate, vinyl propionate, vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxyacetate, vinyl benzoate, ethyl α-ethoxyacrylate, alkyl acrylates and alkyl methacrylates having a $C_{1-11}$ alkyl group (linear chain or branched) (methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate), dialkyl fumarates (the dialkyl esters of fumaric acid) (the two alkyl groups are linear chain, branched chain, or alicyclic groups having from 2 to 8 carbons), and dialkyl maleates (the dialkyl esters of maleic acid) (the two alkyl groups are linear chain, branched chain, or alicyclic groups having from 2 to 8 carbons); polyallyloxyalkanes (diallyloxyethane, triallyloxyethane, tetraallyloxyethane, tetrallyloxypropane, tetraallyloxybutane, tetramethallyloxyethane); vinylic monomers that have a polyalkylene glycol chain (polyethylene glycol (molecular weight=300) monoacrylate, polyethylene glycol (molecular weight=300) monomethacrylate, polypropylene glycol (molecular weight=500) monoacrylate, polypropylene glycol (molecular weight=500) monomethacrylate, the acrylate of a methyl alcohol/10 mol ethylene oxide adduct (ethylene oxide is abbreviated as EO below), the methacrylate of a methyl alcohol/10 mol ethylene oxide adduct (ethylene oxide is abbreviated as EO below), the acrylate of a lauryl alcohol/30 mol EO adduct, and the methacrylate of a lauryl alcohol/30 mol EO adduct); and polyacrylates and polymethacrylates (the polyacrylates and polymethacrylates of polyhydric alcohols).

Among the preceding, the copolymerization of styrene and methacrylic acid as the other vinylic monomer is preferred.

The resin B may be a polymer having a crosslink structure. The introduction of a crosslink structure may be carried out using the aforementioned polymerizable unsaturated group-bearing polyester, or may be carried out using a polyfunctional monomer, or may be carried out using both of these in combination. This polyfunctional monomer is a monomer that has a plurality of polymerizable unsaturated groups.

When the crosslink structure is introduced in the present invention using a polyfunctional monomer, the polyfunctional monomer used can be exemplified by the following monomers, although this is not a limitation:

polyethylene glycol diacrylate, polypropylene glycol diacrylate, polytetramethylene glycol diacrylate, 1,6-hexanediol diacrylate, neopentyl glycol diacrylate, polyethylene glycol dimethacrylate, polypropylene glycol dimethacrylate, polytetramethylene glycol dimethacrylate, 1,6-hexanediol dimethacrylate, neopentyl glycol dimethacrylate, divinylbenzene, divinylnaphthalene, silicone that has undergone acrylic modification at both terminals, and silicone that has undergone methacrylic modification at both terminals.

Among the preceding, polyfunctional monomers having a weight-average molecular weight from 200 to 2,000 are particularly preferred. Long-chain crosslinking agents as represented by the following formula (A) are also preferred for the polyfunctional monomer.

(A)

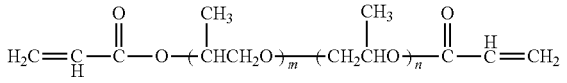

(In the formula, m and n are each independently integers from 1 to 10 and m+n is 2 to 16.)

For resin B, the content of the segment $b_2$ originating from the crystalline resin $B_2$ is preferably from 0.5 mass parts to 4.0 mass parts (more preferably from 0.5 mass parts to 3.0 mass parts) per 100 mass parts of the binder resin. In addition, the content of the segment $b_2$ originating from the crystalline resin $B_2$ is preferably from 10.0 mass % to 50.0 mass % (more preferably from 15.0 mass % to 40.0 mass %) with respect to the total of the segment $b_1$ originating from the crystalline resin $B_1$ and the segment $b_2$ originating from the crystalline resin $B_2$. This has the effect of supporting the promotion of the crystallization of the crystalline resin A after the fixing-induced heating and melting and thus of facilitating additional improvements in the stability of the fixed image in severe environments.

In addition, the total of the content of the segment $b_1$ originating from the crystalline resin $B_1$ and the content of the segment $b_2$ originating from the crystalline resin $B_2$ in the resin B is preferably from 20.0 mass % to 60.0 mass %.

For the toner particle of the present invention, the content of the resin B is preferably from 3.0 mass parts to 15.0 mass parts per 100 mass parts of the binder resin. From 3.0 mass parts to 12.0 mass parts is more preferred. This has the effect of facilitating a further increase in the crystallization of the crystalline resin A after the fixing-induced heating and melting and thus of facilitating additional improvements in the stability of the fixed image in severe environments.

The binder resin for the toner of the present invention is described in detail in the following.

The toner of the present invention contains the crystalline resin A as binder resin. Through the incorporation of the crystalline resin A, the viscosity after melting is lowered and the generation of an excellent low-temperature fixability is facilitated.

The melting point of the crystalline resin A is preferably from 50.0° C. to 80.0° C.

Crystalline resin A usable for the binder resin can be exemplified by crystalline polyesters, crystalline alkyl resins, crystalline polyurethanes, and crystalline polyureas. The use of a crystalline polyester or crystalline alkyl resin is preferred.

The crystalline polyester is preferably a crystalline polyester obtained by reacting an aliphatic diol with an aliphatic dicarboxylic acid. In addition, a crystalline polyester obtained by the reaction of a $C_{3-10}$ aliphatic diol and a $C_{6-14}$ aliphatic dicarboxylic acid is more preferred. That is, the crystalline resin A is preferably a crystalline polyester resin having a unit derived from a $C_{3-10}$ linear chain aliphatic diol and a unit derived from a $C_{6-14}$ linear chain aliphatic dicarboxylic acid.

In addition, the aliphatic diol and aliphatic dicarboxylic acid are preferably a linear chain type. A crystalline polyester having a higher crystallinity is obtained through the use of linear chain types. The materials constituting the aforementioned crystalline resin $B_1$ and crystalline resin $B_2$ are used as the $C_{3-10}$ aliphatic diol and $C_{6-14}$ aliphatic dicarboxylic acid.

An aromatic carboxylic acid can also be used. Aromatic dicarboxylic acids can be exemplified by the following compounds: terephthalic acid, isophthalic acid, 2,6-naphthalenedicarboxylic acid, and 4,4'-biphenyldicarboxylic acid.

Among the preceding, terephthalic acid is preferred from the standpoint of the ease of acquisition and the facile formation of a low melting point polymer.

A dicarboxylic acid having a double bond can also be used. A dicarboxylic acid having a double bond, because it enables crosslinking of the resin as a whole utilizing this double bond, can be favorably used to prevent hot offset during fixing.

A resin provided by the polymerization of a vinyl monomer containing a linear chain type alkyl group in its molecular structure is an example of a crystalline alkyl resin.

An alkyl acrylate or alkyl methacrylate having at least 12 carbons in the alkyl group is preferred for the vinyl monomer containing a linear chain type alkyl group in its molecular structure and can be exemplified by the following: lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate, and behenyl methacrylate.

The method of producing the crystalline alkyl resin is preferably polymerization at a temperature of at least 40° C. and generally from 50° C. to 90° C.

In addition to the crystalline resin A, an amorphous resin may also be used in combination therewith as binder resin in the toner of the present invention.

This amorphous resin does not exhibit a clear maximum endothermic peak in differential scanning calorimetric measurement. However, the glass transition temperature (Tg) of the amorphous resin is preferably from 50.0° C. to 130.0° C. and more preferably from 55.0° C. to 110.0° C.

Specific examples of the amorphous resin are amorphous polyester resins, polyurethane resins, polyvinyl resins, and polyurea resins. These resins may also be modified by urethane, urea, or epoxy. Among the preceding, and viewed in terms of elasticity retention, amorphous polyester resins, polyvinyl resins, and polyurethane resins are preferred examples.

The amorphous polyester resins are described in the following. Monomer that can be used to produce amorphous polyester resin can be exemplified by heretofore known dibasic or at least tribasic carboxylic acids and dihydric or at least trihydric alcohols. Specific examples of these monomers are given in the following.

The dibasic carboxylic acids can be exemplified by the following compounds: dibasic acids such as succinic acid, adipic acid, sebacic acid, phthalic acid, isophthalic acid, terephthalic acid, malonic acid, and dodecenylsuccinic acid and their anhydrides and lower alkyl esters as well as aliphatic unsaturated dicarboxylic acids such as maleic acid, fumaric acid, itaconic acid, and citraconic acid. The at least tribasic carboxylic acids can be exemplified by the following compounds: 1,2,4-benzenetricarboxylic acid and 1,2,5-benzenetricarboxylic acid and their anhydrides and lower alkyl esters. A single one of these may be used by itself or two or more may be used in combination.

The dihydric alcohols can be exemplified by the following compounds: alkylene glycols (ethylene glycol, 1,2-propylene glycol, and 1,3-propylene glycol), alkylene ether glycols (polyethylene glycol and polypropylene glycol), alicyclic diols (1,4-cyclohexanedimethanol), bisphenols (bisphenol A), and alkylene oxide (ethylene oxide and propylene oxide) adducts on alicyclic diols.

The alkyl moiety in the alkylene glycols and alkylene ether glycols may be linear chain or branched. Alkylene glycols having a branched structure are preferably used in the present invention.

The at least trihydric alcohols can be exemplified by the following compounds: glycerol, trimethylolethane, trimethylolpropane, and pentaerythritol. A single one of these may be used by itself or two or more may be used in combination.

With the goal of adjusting the acid value and/or the hydroxyl value, as necessary a monobasic acid such as acetic acid or benzoic acid and/or a monohydric alcohol such as cyclohexanol or benzyl alcohol may also be used. The method of synthesizing the amorphous polyester resin is not particularly limited, and, for example, a transesterification method or direct polycondensation method can be used, either by itself or in combination.

The amorphous polyurethane resins are described in the following. Polyurethane resins are the reaction products of a diol with a substance containing two isocyanate groups, and resins having various functionalities can be obtained by adjusting the diol and the diisocyanate.

The diisocyanate component is exemplified by the following: aromatic diisocyanates that have from 6 to 20 carbons (excluding the carbons in the NCO groups; this also applies to the following), aliphatic diisocyanates that have from 2 to 18 carbons, alicyclic diisocyanates that have from 4 to 15 carbons, modifications of these diisocyanates (modifications containing the urethane group, carbodiimide group, allophanate group, urea group, biuret group, uretdione group, uretonimine group, isocyanurate group, or oxazolidone group; also referred to hereafter as "modified diisocyanates"), and mixtures of two or more of the preceding.

The aromatic diisocyanates can be exemplified by the same aromatic diisocyanates as described above in relation to the polymerizable unsaturated group-bearing polyester.

The aliphatic diisocyanates can also be exemplified by the same aliphatic diisocyanates as described above in relation to the polymerizable unsaturated group-bearing polyester.

The alicyclic diisocyanates can also be exemplified by the same alicyclic diisocyanates as described above in relation to the polymerizable unsaturated group-bearing polyester.

Among the preceding, aromatic diisocyanates having from 6 to 15 carbons, aliphatic diisocyanates having from 4 to 12 carbons, and alicyclic diisocyanates having from 4 to 15 carbons are preferred, with XDI, IPDI, and HDI being particularly preferred.

In addition to the diisocyanate component, trifunctional and higher functional isocyanate compounds may also be used.

The diol component usable for the polyurethane resin can be the same dihydric alcohols as those usable for the previously described amorphous polyester.

The amorphous vinyl resins are described in the following. The monomers usable for the production of amorphous vinyl resins can be the same monomers as those usable for the previously described crystalline resin $B_1$ and crystalline resin $B_2$.

The incorporation as the binder resin of a block polymer in which a crystalline resin component (the crystalline resin A) is chemically bonded to an amorphous resin component is a preferred embodiment in the present invention. Here, a block polymer in which a crystalline polyester resin is chemically bonded to an amorphous resin is preferred.

The block polymer can be exemplified by XY diblock polymers, XYX triblock polymers, Y×Y triblock polymers, and XYXY . . . multiblock polymers of a crystalline resin component (X) and an amorphous resin component (Y), and any mode can be used.

The following method can be used to prepare the block polymer in the present invention: a method in which a component that will form a crystalline portion constituted of the crystalline resin component and a component that will form an amorphous portion constituted of the amorphous resin component are separately prepared and the two are then bonded (two-stage method). In addition to this, a method can be used in which the starting materials for the component that will form the crystalline portion and the component that will form the amorphous portion are charged simultaneously and production is carried out all at once (single-stage method).

The block polymer can be provided in the present invention by selecting from the different methods based on a consideration of the reactivities of the respective terminal functional groups.

When the crystalline resin component and the amorphous resin component are both polyester resins, preparation may be carried out by bonding, as necessary using a linker, after the individual components have been separately prepared. When, in particular, one of the polyesters has a high acid value and the other polyester has a high hydroxyl value, bonding may be brought about without using a linker. The reaction temperature here is preferably around 200° C.

When a linker is used, this linker can be exemplified by the following: polybasic carboxylic acids, polyhydric alcohols, polyisocyanates, polyfunctional epoxides, and polyfunctional acid anhydrides. Synthesis using these linkers can be carried out by a dehydration reaction or an addition reaction.

When, on the other hand, the crystalline resin component is a polyester and the amorphous resin component is a polyurethane, preparation can be carried out by preparing each component separately and then running a urethanation reaction between terminal alcohol on the polyester and terminal isocyanate on the polyurethane. Synthesis may also be carried out by mixing a polyester having terminal alcohol with the diol and diisocyanate that will form the polyurethane and heating. In the initial phase of the reaction where the diol and diisocyanate are present at high concentrations, the diol and diisocyanate will selectively react to provide the polyurethane, and, once the molecular weight has reached a certain magnitude, the block polymer can be provided through the occurrence of a urethanation reaction between the terminal isocyanate of the polyurethane and the terminal alcohol of the polyester resin.

When the crystalline resin component and amorphous resin component are both vinyl resins, preparation can be carried out by polymerizing one component followed by the initiation, from the terminal of this vinyl polymer, of the polymerization of the other component.

The content of the crystalline resin component in this block polymer is preferably from 50.0 mass % to 90.0 mass % and is more preferably from 60.0 mass % to 85.0 mass %.

Just as for other crystalline resins, this block polymer exhibits a clear endothermic peak originating from the crystalline resin component in differential scanning calorimetric measurement using a differential scanning calorimeter (DSC).

The proportion in the toner of the present invention of the crystalline resin A (preferably crystalline polyester resin) with respect to the total amount of the binder resin is preferably from 50.0 mass % to 90.0 mass % and is more preferably from 60.0 mass % to 85.0 mass %. When a block polymer as described above is used as the binder resin, the crystalline resin component in the block polymer is used for the proportion of the crystalline resin A and the amorphous resin component is not included in the proportion of crystalline resin A.

The toner of the present invention preferably has, in DSC measurement of the toner, a half width of the endothermic peak $P_2$ of not more than 3.0° C. From 0° C. to 2.5° C. is more preferred. Additional increases in the crystallinity of the post-melted toner are facilitated by having the half width be not more than 3.0° C., and as a result the occurrence of a reduction in the crystallinity is inhibited—even when the fixed image is stored in a severe environment—and improvements in the stability are facilitated.

In addition, the toner of the present invention preferably has, in DSC measurement of the toner, an endothermic quantity ΔH for the endothermic peak $P_2$ of from 20.0 (J/g) to 100.0 (J/g). Additional increases in the crystallinity of the post-melted toner are facilitated by having ΔH be in the indicated range, and as a result additional improvements in the stability of the fixed image in severe environments are facilitated.

The aforementioned Tt and T't for the toner of the present invention preferably satisfy the following formula (8) in DSC measurement of the toner.

$$0.0 \leq T't - Tt \leq 5.0 \quad \text{formula (8)}$$

A better coexistence of the low-temperature fixability with the stability of the fixed image in severe environments is facilitated by having T't-Tt be in the indicated range. T't-Tt is more preferably from 0.0° C. to 2.0° C.

As obtained by GPC measurement of the THF-soluble matter from the toner, the toner of the present invention preferably has a number-average molecular weight (Mn) of from 8,000 to 30,000 and a weight-average molecular weight (Mw) of from 15,000 to 60,000. A more preferred range for Mn is from 10,000 to 20,000, and a more preferred range for Mw is from 20,000 to 50,000. In addition, Mw/Mn is preferably not more than 6. A more preferred range for Mw/Mn is 3 and below.

In a preferred embodiment the toner particle used in the toner of the present invention also contains a wax. There are no particular limitations on this wax, and it can be exemplified by the following:

aliphatic hydrocarbon waxes such as low molecular weight polyethylene, low molecular weight polypropylene, low molecular weight olefin copolymers, microcrystalline waxes, paraffin waxes, and Fischer-Tropsch waxes; the oxides of aliphatic hydrocarbon waxes, such as oxidized polyethylene wax; waxes for which the main component is a fatty acid ester, such as aliphatic hydrocarbon ester waxes; waxes provided by the partial or complete deacidification of fatty acid esters, such as deacidified carnauba wax; partial esters between a fatty acid and a polyhydric alcohol, such as behenyl monoglyceride; and the hydroxyl group-bearing methyl ester compounds obtained by the hydrogenation of vegetable oils.

Aliphatic hydrocarbon waxes and ester waxes are waxes particularly preferred for use in the toner of the present invention. In addition, the ester wax used by the present invention is preferably the ester of a trihydric or higher hydric alcohol with an aliphatic monocarboxylic acid or the ester of a tribasic or higher basic carboxylic acid with an aliphatic monoalcohol. More preferred is the ester of a tetrahydric or higher hydric alcohol with an aliphatic monocarboxylic acid or the ester of a tetrabasic or higher basic carboxylic acid with an aliphatic monoalcohol. Particularly preferred is the ester of a hexahydric or high hydric alcohol with an aliphatic monocarboxylic acid or the ester of a hexabasic or higher basic carboxylic acid with an aliphatic monoalcohol.

Trihydric and higher hydric alcohols that can be used in the wax can be exemplified by the following, although there is no limitation to these and combinations may also be used depending on the case: glycerol, trimethylolpropane, erythritol, pentaerythritol, and sorbitol. Their condensation products can be exemplified by the so-called polyglycerols provided by the condensation of glycerol, e.g., diglycerol, triglycerol, tetraglycerol, hexaglycerol, and decaglycerol; ditrimethylolpropane and tristrimethylolpropane, which are provided by the condensation of trimethylolpropane; and dipentaerythritol and trispentaerythritol, which are provided by the condensation of pentaerythritol. Among these, structures having a branched structure are preferred; pentaerythritol or dipentaerythritol is more preferred; and dipentaerythritol is particularly preferred.

For the aliphatic monocarboxylic acid that can be used in the present invention, those represented by the general formula $C_nH_{2n+1}COOH$ where n is from 5 to 28 are preferably used.

The following are examples, although there is no limitation to these and combinations may also be used depending on the case: caproic acid, caprylic acid, octylic acid, nonylic acid, decanoic acid, dodecanoic acid, lauric acid, tridecanoic acid, myristic acid, palmitic acid, stearic acid, and behenic acid. Myristic acid, palmitic acid, stearic acid, and behenic acid are preferred from the perspective of the melting point of the wax.

Tribasic and higher basic carboxylic acids that can be used in the present invention can be exemplified by the following, although there is no limitation to these and combinations may also be used depending on the case: trimellitic acid, butanetetracarboxylic acid.

For the aliphatic monoalcohol that can be used in the present invention, those represented by the general formula $C_nH_{2n+1}OH$ where n is from 5 to 28 are preferably used.

The following are examples, although there is no limitation to these and combinations may also be used depending on the case: caprylic alcohol, lauryl alcohol, myristyl alcohol, palmityl alcohol, stearyl alcohol, and behenyl alcohol. Myristyl alcohol, palmityl alcohol, stearyl alcohol, and behenyl alcohol are preferred from the perspective of the melting point of the wax.

The content of the wax in the toner particle in the toner of the present invention is preferably from 1.0 mass % to 20.0 mass % and is more preferably from 2.0 mass % to 15.0 mass %. When the wax content is from 1.0 mass % to 20.0 mass %, the release characteristics of the toner are improved and wrap around by the transfer paper when the fixing unit is brought to low temperatures can then be suppressed. Moreover, exposure of the wax at the toner surface is suppressed and an excellent heat-resistant storability is obtained.

The wax preferably has a maximum endothermic peak, in measurement with a differential scanning calorimeter (DSC), of from 60° C. to 120° C. From 60° C. to 90° C. is more preferred. When the maximum endothermic peak is from 60° C. to 120° C., exposure of the wax at the toner surface is suppressed and an excellent heat-resistant storability is obtained. In addition, the wax melts appropriately during fixing and as a result the low-temperature fixability and offset resistance are improved.

The toner of the present invention may contain a colorant. Colorants that are preferred for use in the present invention can be exemplified by organic pigments, organic dyes, inorganic pigments, carbon black functioning as a black colorant, and magnetic particles.

Yellow colorants can be exemplified by the following: condensed azo compounds, isoindolinone compounds, anthraquinone compounds, azo metal complexes, methine compounds, and allylamide compounds. Specifically, C. I. Pigment Yellow 12, 13, 14, 15, 17, 62, 74, 83, 93, 94, 95, 109, 110, 111, 128, 129, 147, 155, 168, and 180 are advantageously used.

Magenta colorants can be exemplified by the following: condensed azo compounds, diketopyrrolopyrrole compounds, anthraquinone, quinacridone compounds, basic dye lake compounds, naphthol compounds, benzimidazolone compounds, thioindigo compounds, and perylene compounds. Specifically, C. I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254 are advantageously used.

The cyan colorants can be exemplified by the following: copper phthalocyanine compounds and their derivatives, anthraquinone compounds, and basic dye lake compounds. Specifically, C. I. Pigment Blue 1, 7, 15, 15:1, 15:2, 15:3, 15:4, 60, 62, and 66 are advantageously used.

The colorant used in the toner of the present invention is selected considering the hue angle, chroma, lightness, lightfastness, OHP transparency, and dispersibility in the toner.

The colorant is preferably used added at from 1.0 mass parts to 20.0 mass parts per 100 mass parts of the binder resin. When magnetic particles are used as the colorant, their amount of addition is preferably from 40.0 mass parts to 150.0 mass parts per 100 mass parts of the binder resin.

The toner particle in the toner of the present invention may as necessary contain a charge control agent. External addition to the toner particle may also be carried out. The incorporation of a charge control agent makes it possible to stabilize the charging characteristics and to control the amount of optimal triboelectric charging in accordance with the developing system.

A known charge control agent can be used as the charge control agent, and a charge control agent that supports a rapid charging speed and that can stably maintain a constant amount of charge is preferred in particular.

Charge control agents that control the toner to a negative chargeability can be exemplified by the following: organometal compounds and chelate compounds are effective, e.g., monoazo metal compounds, acetylacetone-metal compounds, and metal compounds of aromatic oxycarboxylic acids, aromatic dicarboxylic acids, oxycarboxylic acids, and dicarboxylic acids. Charge control agents that control the toner to a positive chargeability can be exemplified by the following: nigrosine, quaternary ammonium salts, metal salts of higher fatty acids, diorganotin borates, guanidine compounds, and imidazole compounds. A preferred amount of incorporation for the charge control agent is from 0.01 mass parts to 20.0 mass parts per 100 mass parts of the toner particle, while from 0.5 mass parts to 10.0 mass parts is more preferred.

Any procedure may be used as the method for producing the toner particle for the toner of the present invention; however, the toner particle preferably has a core/shell structure and as a consequence the various methods that form a core/shell structure are preferred. Formation of the shell phase may be carried out at the same time as the core formation step or may be carried out after formation of the core. Considered in terms of greater convenience, the core production step and the shell phase formation step are preferably carried out at the same time.

For the case in which the shell phase is established after core formation, the method for forming the shell phase can be exemplified by the following method: dispersion in an aqueous medium of the core and the resin fine particles that will form the shell phase, followed by aggregation and adsorption of the resin fine particles to the core surface. When shell phase formation is carried out at the same time as the core formation step, a dissolution suspension method as follows is preferably used: a resin composition obtained by dissolving the core-forming binder resin in an organic medium, is dispersed in a dispersion medium in which shell phase-forming resin fine particles are dispersed, and after this the organic medium is removed to obtain toner particles.

The toner particle used in the toner of the present invention is particularly preferably a toner particle that has been produced in a nonaqueous medium. Accordingly, a dissolution suspension method that uses high-pressure carbon dioxide as the dispersion medium is particularly favorable for the production of the toner particle of the present invention.

That is, the toner particle in the toner of the present invention is preferably a toner particle that has been produced by the following production method. First, a resin composition is prepared by dissolving or dispersing the binder resin and as necessary a colorant and wax in a medium that contains an organic solvent. Then, a dispersion is prepared by dispersing the resin composition, in the presence of resin fine particles that will form the shell phase, in a dispersion medium for which the main component is high-pressure carbon dioxide. Toner particles are produced by removing the organic solvent from the obtained dispersion.

Here, the high-pressure carbon dioxide is preferably carbon dioxide at a pressure of at least 1.5 MPa. In addition, liquid carbon dioxide or carbon dioxide in a supercritical state may be used by itself as the dispersion medium, or an organic solvent may be present as an additional component. In this case, the high-pressure carbon dioxide and the organic solvent preferably form a homogeneous phase.

As an example, the production of toner particles using a dispersion medium that contains high-pressure carbon dioxide, which is an advantageous method for obtaining the toner particle used in the toner of the present invention, is described in the following.

First, in a resin composition preparation step, the binder resin and as necessary a colorant, wax, and other additives are added to an organic solvent capable of dissolving the binder resin and dissolution or dispersion to uniformity is carried out using a dispersing device such as a homogenizer, ball mill, colloid mill, or ultrasonic disperser.

Then, in a granulating step, the thusly obtained resin composition is mixed with high-pressure carbon dioxide to form droplets of the resin composition.

Here, a dispersant may have been dispersed in advance in the high-pressure carbon dioxide functioning as the dispersion medium. The resin fine particles for forming the shell phase are an example of the dispersant, but another component may be mixed as the dispersant. This may be, for example, an inorganic fine particle dispersant, an organic fine particle dispersant, or their mixture, and two or more may be used in combination in accordance with the objectives. The resin fine particles for forming the shell phase may also be preliminarily mixed into the resin composition.

A liquid-state dispersion stabilizer may also be added. The dispersion stabilizer can be exemplified by compounds that contain the aforementioned organopolysiloxane structure and/or fluorine and that have a high affinity for carbon dioxide and by various surfactants, i.e., nonionic surfactants, anionic surfactants, and cationic surfactants. These dispersion stabilizers are discharged from the system along with the carbon dioxide in the ensuing solvent removal step. The amount remaining in the toner particle after toner particle production is thus very small.

Any method may be used in the production of the toner particle used in the toner of the present invention as the method of dispersing the dispersant in the dispersion medium containing high-pressure carbon dioxide. A specific example is a method in which the dispersant and the dispersion medium containing high-pressure carbon dioxide are introduced into a vessel and direct dispersion is carried out by stirring or exposure to ultrasound. Another example is a method in which a dispersion having the dispersant dispersed in an organic solvent, is introduced using a high-pressure pump into a vessel already charged with dispersion medium containing high-pressure carbon dioxide.

Any method may be used in the present invention as the method for dispersing the resin composition in the dispersion medium containing high-pressure carbon dioxide. A specific example is a method in which the resin composition is introduced using a high-pressure pump into a vessel that has been filled with dispersion medium containing high-pressure carbon dioxide and having the dispersant dispersed therein. In addition, the dispersion medium containing high-pressure carbon dioxide and having the dispersant dispersed therein may be introduced into a vessel that has been charged with the resin composition.

The dispersion medium containing high-pressure carbon dioxide is preferably a single phase in the present invention. When granulation is carried out by dispersing the resin composition in high-pressure carbon dioxide, a portion of the organic solvent in the droplets is transferred into the dispersion medium. At this time, the presence of the carbon dioxide phase and organic solvent phase in a dispersed state can cause a loss of stability by the droplets. It is therefore preferred that the temperature and pressure of the dispersion medium and the amount of the resin composition relative to the high-pressure carbon dioxide be adjusted within a range in which the carbon dioxide and organic solvent can form a homogeneous phase.

In addition, care must also be exercised with the temperature and pressure of the dispersion medium with regard to the granulating properties (ease of droplet formation) and the solubility in the dispersion medium of constituent components in the resin composition. For example, the binder resin and wax in the resin composition can dissolve in the dispersion medium depending on the temperature and pressure conditions. As a general matter, at lower temperatures and lower pressures the solubility of these components in the dispersion medium is suppressed while aggregation·coalescence of the droplets formed is facilitated and the granulating properties are then reduced. On the other hand, at higher temperatures and higher pressures, the granulating properties are improved, but a trend is exhibited in which dissolution of these components into the dispersion medium is facilitated. Accordingly, the temperature of the dispersion medium in the production of the toner particle of the present invention is preferably in the temperature range from 10° C. to 50° C.

In addition, the pressure within the vessel where the dispersion medium is formed is preferably from 1.5 MPa to 20.0 MPa and is more preferably from 2.0 MPa to 15.0 MPa. The pressure in the present invention refers to the total pressure when a component besides carbon dioxide is present in the dispersion medium.

After the completion of granulation in this manner, in a solvent removal step the organic solvent remaining in the droplets is removed via the dispersion medium using high-pressure carbon dioxide. Specifically, this is carried out by mixing additional high-pressure carbon dioxide into the dispersion medium in which the droplets are dispersed; extracting the remaining organic solvent into the carbon dioxide phase; and replacing this organic solvent-containing carbon dioxide with additional high-pressure carbon dioxide.

With regard to the mixing of the dispersion medium with the high-pressure carbon dioxide, a carbon dioxide at a higher pressure than the dispersion medium may be added to the dispersion medium, or the dispersion medium may be added to carbon dioxide at a lower pressure than the dispersion medium.

The method for replacing the organic solvent-containing carbon dioxide with additional high-pressure carbon dioxide can be exemplified by causing high-pressure carbon dioxide to flow through while holding the pressure within the vessel constant. This is carried out while trapping the formed toner particles with a filter.

When replacement by high-pressure carbon dioxide is not satisfactory and a state is assumed in which organic solvent remains in the dispersion medium, when the vessel is depressurized in order to recover the obtained toner particles the organic solvent dissolved in the dispersion medium can condense and the toner particles can be redissolved. In addition, the problem of the coalescence of the toner particles with each other may also be produced. Accordingly, substitution with the high-pressure carbon dioxide must be carried out until the organic solvent has been completely removed. The amount of throughflowed high-pressure carbon dioxide is preferably from 1-time to 100-times the volume of the dispersion medium and is more preferably from 1-time to 50-times and is even more preferably from 1-time to 30-times.

When the vessel is depressurized and the toner particles are removed from the dispersion containing high-pressure carbon dioxide in which the toner particles are dispersed, depressurization to normal temperature and normal pressure may be done all at once, or a stagewise depressurization may be done by passing the independently pressure-controlled vessel through multiple stages. The depressurization rate is preferably established in a range in which the toner particles do not foam.

The organic solvent and carbon dioxide used in the present invention can be recycled.

The addition of inorganic fine particles to the toner particle as a flowability improver is preferred for the toner of the present invention. The inorganic fine particles added to the toner particle can be exemplified by fine particles such as silica fine particles, titanium oxide fine particles, alumina fine particles, and their complex oxide fine particles. Among these inorganic fine particles, silica fine particles and titanium oxide fine particles are preferred.

The silica fine particles can be exemplified by a fumed silica or dry silica produced by the vapor-phase oxidation of a silicon halide, and by a wet silica produced from, for example, water glass. Between these, dry silica, which has little silanol group at the surface or within the silica fine particle and which has little $Na_2O$ and $SO_3^{2-}$, is preferred. Moreover, the dry silica may also be a composite fine particle of silica and another metal oxide produced by the use in the production process of a metal halide compound, for example, aluminum chloride or titanium chloride, along with the silicon halide compound.

The inorganic fine particles are preferably externally added to the toner particle in order to improve the flowability of the toner and make toner charging uniform. In addition, the use of hydrophobically treated inorganic fine particles is more preferred because an improved regulation of the amount of charge on the toner, an improved environmental stability, and improvements in the properties in high-humidity environments can be achieved by subjecting the inorganic fine particles to a hydrophobic treatment.

The treatment agent used for the hydrophobic treatment of the inorganic fine particles can be exemplified by unmodified silicone varnishes, variously modified silicone varnishes, unmodified silicone oils, variously modified silicone oils, silane compounds, silane coupling agents, organosilicon compounds other than the preceding, and organotitanium compounds. A single one of these treatment agents may be used or two or more may be used in combination.

Among the preceding, inorganic fine particles that have been treated with a silicone oil are preferred. Silicone oil-treated hydrophobic-treated inorganic fine particles provided by treating inorganic fine particles with a silicone oil either at the same time or after their hydrophobic treatment with a coupling agent, are more preferred from the standpoint of maintaining a high amount of charge on the toner particle and reducing selective development even in a high-humidity environment.

The amount of addition of the inorganic fine particles is preferably from 0.1 mass parts to 4.0 mass parts per 100 mass parts of the toner particle. From 0.2 mass parts to 3.5 mass parts is more preferred.

The methods used to measure various properties of the toner of the present invention are described in the following.

<Methods for measuring Tt, T't, TA, $TB_1$, $TB_2$, ΔH, $\Delta H_{T't-3}$, and the half width>

TA, $TB_1$, $TB_2$, ΔH, and $\Delta H_{T't-3}$ of the toner of the present invention and its materials are measured under the following conditions using a Q1000 DSC (TA Instruments).

ramp rate: 10° C./min measurement start temperature: 20° C.

measurement end temperature: 180° C.

Temperature correction in the instrument detection section is performed using the melting points of indium and zinc, and the amount of heat is corrected using the heat of fusion of indium.

Specifically, approximately 5 mg of the sample is precisely weighed out and this is introduced into an aluminum pan and the differential scanning calorimetric measurement is then carried out. An empty silver pan is used as the reference. First, the temperature is raised to 180° C. at a rate of 10° C./min in a first ramp up process, and this is followed by cooling to 20° C. at a rate of 10° C./min. A second ramp up process is subsequently carried out in the same manner. The peak temperatures and endothermic quantities are calculated for each peak.

When the toner is used for the sample and the maximum endothermic peak (endothermic peak originating from the crystalline resin A) does not overlap with the endothermic peak for the wax, the obtained maximum endothermic peak is directly handled as the endothermic peak originating from the crystalline resin A. On the other hand, when the toner is used as the sample and the endothermic peak for the wax overlaps with the maximum endothermic peak, the endothermic quantity originating from the wax must be subtracted from the maximum endothermic peak.

For example, the following method can be used to obtain the endothermic peak originating from the crystalline resin A by subtracting the endothermic quantity originating from the wax from the maximum endothermic peak that is obtained.

First, a separate DSC measurement is carried out for the wax itself to determine the endothermic characteristics. The wax content in the toner is then determined. There are no particular limitations on the measurement of the wax content in the toner, but it can be carried out, for example, by peak separation in the DSC measurement and/or by a known structural analysis. After this, the endothermic quantity attributable to the wax may be calculated from the wax content in the toner, and this quantity may be subtracted from the maximum endothermic peak. When the wax is readily compatible with the resin component, the endothermic quantity attributable to the wax must be calculated and subtracted after multiplying the wax content by a compatibility factor. This compatibility factor is calculated from the value yielded by dividing the endothermic quantity determined for a mixture at a prescribed ratio of the wax and the melt mixture of the resin component, by the theoretical endothermic quantity calculated from the preliminarily determined endothermic quantity for this melt mixture and the endothermic quantity for the wax itself.

In addition, in the measurements, in order to provide an endothermic quantity per 1 g of the binder resin, the mass of the components other than the binder resin must be eliminated from the mass of the sample.

The content of the components other than the resin component can be measured using known analytical means. When analysis is problematic, the incineration ash content of the toner is determined; the amount provided by adding to this the amounts of the components other than the binder resin that are incinerated, e.g., the wax and so forth, is then assumed to be the content of the components other than the binder resin; and the determination can be made by subtracting this from the mass of the toner.

The incineration ash content in the toner is determined by the following procedure. Approximately 2 g of the toner is introduced into a 30-mL porcelain crucible that has been precisely weighed in advance. The crucible is introduced into an electric furnace and is heated for about 3 hours at about 900° C.; spontaneous cooling is carried out in the electric furnace and for at least one hour in a desiccator at normal temperature; the mass of the crucible containing the incinerated ash content is precisely weighed; and the incineration ash content is calculated by subtracting the mass of the crucible.

When a plurality of peaks are present, the maximum endothermic peak is the peak for which the endothermic quantity is the maximum. In addition, the half width is the temperature interval at half of the peak height of the endothermic peak.

The endothermic quantity ΔH is calculated by analysis using the DSC software of the endothermic quantity originating from the crystalline resin A from the temperature lower than T't by 20.0° C. to the temperature higher than T't by 10.0° C. In addition, $\Delta H_{T't-3}$ is calculated by analysis using the DSC software of the endothermic quantity originating from the crystalline resin A from the temperature lower than T't by 20.0° C. to the temperature lower than T't by 3.0° C.

<Method for Measuring Mn and Mw>

The molecular weights (Mn, Mw) of the THF-soluble matter of the toner used by the present invention and its materials are measured as described below using gel permeation chromatography (GPC).

First, the sample is dissolved in tetrahydrofuran (THF) over 24 hours at room temperature. The obtained solution is filtered across a "Sample Pretreatment Cartridge" solvent-resistant membrane filter with a pore diameter of 0.2 μm (from the Tosoh Corporation) to obtain the sample solution. The sample solution is adjusted to a THF-soluble component concentration of approximately 0.8 mass %. The measurement is performed under the following conditions using this sample solution.

instrument: HLC8120 GPC (detector: RI) (from the Tosoh Corporation)

columns: 7-column train of Shodex KF-801, 802, 803, 804, 805, 806, and 807 (from Showa Denko Kabushiki Kaisha)

eluent: tetrahydrofuran (THF)

flow rate: 1.0 mL/minute oven temperature: 40.0° C.

sample injection amount: 0.10 mL

The calibration curve used to determine the molecular weight of the sample is constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, and A-500", from the Tosoh Corporation).

<Method for Measuring the Melting Point of the Wax>

The melting point of the wax was measured under the following conditions using a Q1000 DSC (TA Instruments).

ramp rate: 10° C./min measurement start temperature: 20° C.

measurement end temperature: 180° C.

Temperature correction in the instrument detection section is performed using the melting points of indium and zinc, and the amount of heat is corrected using the heat of fusion of indium.

Specifically, approximately 2 mg of the wax is precisely weighed out; this is introduced into a silver pan; and a differential scanning calorimetric measurement is carried out using an empty silver pan as the reference. The measurement is carried out by initially raising the temperature to 180° C., then cooling to 20° C., and then reheating. The temperature representing the maximum endothermic peak in the DSC curve in the temperature range from 20° C. to 180° C. in this second ramp up process is taken to be the melting point of the wax. When a plurality of peaks are present, the maximum endothermic peak is regarded to be the peak with the largest endothermic quantity.

<Method for measuring the particle diameter of the shell resin dispersant, the wax fine particles, and the colorant fine particles>

The particle diameter of the various fine particles is measured in the present invention as the volume-average particle diameter (μm or nm) using a Microtrac HRA (X-100) particle size distribution analyzer (Nikkiso Co., Ltd.) and carrying out the measurement at a range setting of 0.001 μm to 10 μm. Water is selected as the dilute organic solvent.

EXAMPLES

The present invention is more specifically described in the production examples and examples provided below, but this in no way limits the present invention. The "parts" and "%" for the various materials in the examples and comparative examples are in all cases on a mass basis unless specifically indicated otherwise.

<Synthesis of Crystalline Polyester 1>

While introducing nitrogen, the following starting materials were charged to a two-neck flask that had been dried by heating.

| | |
|---|---|
| 1,6-hexanediol | 79.0 parts |
| sebacic acid | 121.0 parts |
| fumaric acid | 4.0 parts |
| dibutyltin oxide | 0.1 parts |

After nitrogen substitution of the system interior by a pressure reduction process, stirring was carried out for 6 hours at 180° C. Then, while continuing to stir, the temperature was gradually raised to 230° C. under reduced pressure followed by holding for an additional 2 hours. Crystalline polyester 1 was synthesized by air cooling, once a viscous state had been assumed, to stop the reaction. The properties of crystalline polyester 1 are given in Table 1. A clear endothermic peak is observed in differential scanning calorimetric measurement of crystalline polyester 1 using a differential scanning calorimeter (DSC), thus confirming that crystalline polyester 1 is a crystalline resin.

TABLE 1

| | diol | | dicarboxylic acid | | fumaric acid | | | | |
|---|---|---|---|---|---|---|---|---|---|
| crystalline polyester No. | monomer used | amount charged (mass parts) | monomer used | amount charged (mass parts) | amount charged (mass parts) | Mn | Mw | Mp | melting point (° C.) |
| 1 | 1,6-hexanediol | 79.0 | sebacic acid | 121.0 | 4.0 | 7300 | 23200 | 22000 | 64.0 |
| 2 | 1,3-propanediol | 58.0 | sebacic acid | 142.0 | 4.0 | 7600 | 24800 | 23200 | 54.6 |
| 3 | 1,10-decanediol | 98.0 | sebacic acid | 102.0 | 4.0 | 8100 | 26300 | 25500 | 74.7 |
| 4 | 1,6-hexanediol | 72.0 | 1,10-decanedicarboxylic acid | 128.0 | 4.0 | 9200 | 27100 | 26400 | 71.3 |
| 5 | 1,4-butanediol | 66.0 | sebacic acid | 134.0 | 4.0 | 7100 | 23100 | 22400 | 60.6 |
| 6 | 1,6-hexanediol | 68.0 | 1,12-dodecanedicarboxylic acid | 132.0 | 4.0 | 7400 | 24200 | 22800 | 78.4 |
| 7 | 1,12-dodecanediol | 106.0 | sebacic acid | 94.0 | 4.0 | 7600 | 25400 | 23200 | 82.7 |
| 8 | 1,12-dodecanediol | 100.0 | 1,10-decanedicarboxylic acid | 100.0 | 4.0 | 7600 | 25700 | 23300 | 96.7 |
| 9 | 1,10-decanediol | 92.0 | 1,10-decanedicarboxylic acid | 108.0 | 4.0 | 8300 | 26600 | 24100 | 87.3 |
| 10 | 1,6-hexanediol | 76.0 | sebacic acid | 124.0 | — | 4800 | 12100 | 10100 | 67.1 |
| 11 | 1,3-propanediol | 57.0 | sebacic acid | 143.0 | — | 5800 | 11800 | 11000 | 58.3 |
| 12 | 1,10-decanediol | 90.0 | 1,10-decanedicarboxylic acid | 110.0 | — | 4900 | 11700 | 10100 | 85.1 |
| 13 | 1,10-decanediol | 95.0 | sebacic acid | 105.0 | — | 6100 | 12200 | 10500 | 75.9 |
| 14 | 1,4-butanediol | 69.0 | adipic acid | 45.0 | — | 5400 | 11800 | 10100 | 56.9 |
| | | | sebacic acid | 86.0 | | | | | |
| 15 | 1,12-dodecanediol | 103.0 | sebacic acid | 97.0 | — | 6100 | 11900 | 10300 | 88.1 |
| 16 | 1,12-dodecanediol | 106.0 | 1,12-dodecanedicarboxylic acid | 94.0 | 4.0 | 9100 | 26400 | 25300 | 106.0 |

<Synthesis of Crystalline Polyesters 2 to 16>

Crystalline polyesters 2 to 16 were synthesized proceeding entirely as in Synthesis of Crystalline Polyester 1, but changing the type and amount charged of the starting materials used as shown in Table 1. The properties of crystalline polyesters 2 to 16 are given in Table 1. A clear endothermic peak is observed in each case in differential scanning calorimetric measurement of the crystalline polyesters 2 to 16 using a differential scanning calorimeter (DSC), thus confirming that crystalline polyesters 2 to 16 are crystalline resins.

<Synthesis of Block Polymer 1>

| | |
|---|---|
| crystalline polyester 10 | 210.0 parts |
| xylylene diisocyanate (XDI) | 56.0 parts |
| cyclohexanedimethanol (CHDM) | 34.0 parts |
| tetrahydrofuran (THF) | 300.0 parts |

The preceding were charged, while carrying out nitrogen substitution, into a reactor equipped with a stirring apparatus and a thermometer. Heating to 50° C. was carried out and a urethanation reaction was performed over 15 hours. The THF solvent was removed by distillation to obtain a block polymer 1. The properties of block polymer 1 are given in Table 2.

<Synthesis of Amorphous Resin 2>

While introducing nitrogen, the following starting materials were charged to a two-neck flask that had been dried by heating.

| | |
|---|---|
| polyoxypropylene(2.2)-2,2-bis(4-hydroxyphenyl)propane | 30.0 parts |
| polyoxyethylene(2.2)-2,2-bis(4-hydroxyphenyl)propane | 33.0 parts |
| terephthalic acid | 21.0 parts |
| trimellitic anhydride | 1.0 parts |
| fumaric acid | 3.0 parts |
| dodecenylsuccinic acid | 15.0 parts |
| dibutyltin oxide | 0.1 parts |

After nitrogen substitution of the system interior by a pressure reduction process, stirring was carried out for 5 hours at 215° C. Then, while continuing to stir, the temperature was gradually raised to 230° C. under reduced pressure followed by holding for an additional 2 hours. Amorphous resin 2, which was an amorphous polyester, was synthesized by air cooling, once a viscous state had been assumed, to stop the reaction. Mn for amorphous resin 2 was 5,200, Mw was 23,000, and Tg was 55° C.

TABLE 2

| block polymer No. | crystalline polyester No. | crystalline polyester (mass parts) | XDI (mass parts) | CHDM (mass parts) | THF (mass parts) | reaction temperature (° C.) | reaction time (hr) | Mn | Mw | TA (° C.) |
|---|---|---|---|---|---|---|---|---|---|---|
| 1 | 10 | 210.0 | 56.0 | 34.0 | 300.0 | 50 | 15 | 12300 | 31400 | 60.1 |
| 2 | 11 | 210.0 | 56.0 | 34.0 | 300.0 | 50 | 15 | 16400 | 34500 | 51.3 |
| 3 | 12 | 210.0 | 56.0 | 34.0 | 300.0 | 50 | 15 | 15800 | 34400 | 78.3 |
| 4 | 13 | 210.0 | 56.0 | 34.0 | 300.0 | 50 | 15 | 11200 | 29800 | 68.8 |
| 5 | 10 | 156.0 | 86.0 | 58.0 | 300.0 | 50 | 15 | 11400 | 31300 | 60.1 |
| 6 | 10 | 264.0 | 26.0 | 10.0 | 300.0 | 50 | 15 | 12800 | 32100 | 60.1 |
| 7 | 14 | 156.0 | 86.0 | 58.0 | 300.0 | 50 | 15 | 13100 | 32200 | 49.4 |
| 8 | 15 | 156.0 | 86.0 | 58.0 | 300.0 | 50 | 15 | 10900 | 29500 | 81.1 |

XDI: xylylene diisocyanate,
CHDM: cyclohexanedimethanol,
THF: tetrahydrofuran

<Synthesis of Block Polymers 2 to 8>

Block polymers 2 to 8 were synthesized proceeding entirely as in Synthesis of Block Polymer 1, but changing the type and amount charged of the starting materials used as shown in Table 2. The properties of block polymers 2 to 8 are shown in Table 2.

<Synthesis of Amorphous Resin 1>

| | |
|---|---|
| xylylene diisocyanate (XDI) | 117.0 parts |
| cyclohexanedimethanol (CHDM) | 83.0 parts |
| acetone | 200.0 parts |

The preceding were charged, while carrying out nitrogen substitution, into a reactor equipped with a stirring apparatus and a thermometer. Heating to 50° C. was carried out and a urethanation reaction was performed over 15 hours. After this, the terminal isocyanate was modified by the addition of 3.0 parts of tertiary-butyl alcohol. The acetone solvent was removed by distillation to obtain an amorphous resin 1. The obtained amorphous resin 1 had an Mn of 4,400 and an Mw of 20,000.

<Preparation of Block Polymer Solutions 1 to 8>

Block polymer solutions 1 to 8 were prepared by introducing 500.0 parts of acetone and 500.0 parts of a block polymer 1 to 8 into a beaker equipped with a stirring apparatus and continuing to stir at a temperature of 40° C. until complete dissolution was achieved.

<Preparation of Crystalline Polyester Solution 1>

A crystalline polyester solution 1 was prepared by introducing 500.0 parts of acetone and 500.0 parts of crystalline polyester 10 into a beaker equipped with a stirring apparatus and continuing to stir at a temperature of 40° C. until complete dissolution was achieved.

<Preparation of Amorphous Resin Solutions 1 and 2>

Amorphous resin solutions 1 and 2 were prepared by introducing 500.0 parts of acetone and 500.0 parts of amorphous resin 1 or 2 into a beaker equipped with a stirring apparatus and continuing to stir at a temperature of 40° C. until complete dissolution was achieved.

<Preparation of Shell Resin Dispersion 1>

While introducing nitrogen, the following starting materials and 800.0 parts of toluene were charged to a two-neck flask that had been dried by heating, and a monomer composition was prepared by heating to 70° C. and effecting complete dissolution.

| | |
|---|---|
| crystalline polyester 1 | 30.0 parts |
| crystalline polyester 7 | 10.0 parts |
| methacrylic-modified organopolysiloxane (X-22-2475, molecular weight = 420, Shin-Etsu Silicone Co., Ltd.) | 25.0 parts |
| styrene | 25.0 parts |
| methacrylic acid | 10.0 parts |
| long-chain crosslinking agent (APG-400, molecular weight = 536, Shin-Nakamura Chemical Co., Ltd.) | 4.0 parts |

The structural formula of X-22-2475 is shown in formula (iii).

(iii)

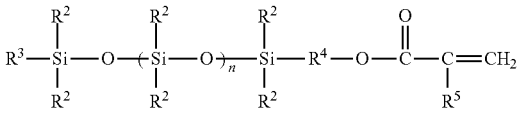

In formula (iii), $R^2$, $R^3$, and $R^5$ represent the methyl group and $R^4$ represents the propylene group. The degree of polymerization n is 3.

The structural formula of APG-400 is shown in formula (iv).

(iv)

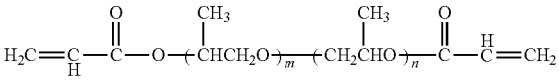

The degree of polymerization m+n in formula (iv) is 7.

This monomer composition was cooled to 25° C. while stirring at 250 rpm; bubbling with nitrogen was carried out for 30 minutes; and 0.6 parts of azobismethoxydimethylvaleronitrile was then mixed in as a polymerization initiator. This was followed by heating to 75° C. and reaction for 6 hours and then heating to 80° C. and reaction for an additional 1 hour. Air cooling was subsequently carried out to obtain a dispersion of a particulate resin.

The obtained dispersion of a coarsely particulate resin was introduced into a temperature-adjustable stirred tank and was processed by transport at a flow rate of 35 g/min using a pump to a Clear SS5 (M Technique Co., Ltd.) to obtain a dispersion of a finely particulate resin. The conditions for processing this dispersion with the Clear SS5 were 15.7 m/s for the peripheral velocity of the outermost peripheral part of the rotating ring-shaped disk of the Clear SS5 and 1.6 μm for the gap between the rotating ring-shaped disk and the fixed ring-shaped disk. The temperature of the stirred tank was adjusted such that the liquid temperature after processing with the Clear SS5 did not exceed 40° C.

The toluene was separated from the resin fine particles in the dispersion using a centrifugal separator at 16,500 rpm for 2.5 hours.

After this, a concentrated dispersion of resin fine particles was obtained by removing the supernatant.

This concentrated dispersion of resin fine particles was dispersed in acetone in a stirring apparatus-equipped beaker using a high-output ultrasound homogenizer (VCX-750) to prepare a shell resin dispersion 1 having a solids concentration of 10.0 mass % and a volume-average particle diameter of 110 nm.

TABLE 3

| | crystalline resin B1 | | crystalline resin B2 | | | styrene | methacrylic | long-chain crosslinking | | volume- |
|---|---|---|---|---|---|---|---|---|---|---|
| shell resin dispersion | resin used (crystalline polyester No.) | amount charged (mass parts) | resin used (crystalline polyester No.) | amount charged (mass parts) | methacrylic-modified organopolysiloxane amount charged (mass parts) | amount charged (mass parts) | acid amount charged (mass parts) | agent amount charged (mass parts) | Cb2-Cb1 | average particle diameter (nm) |
| 1 | 1 | 30.0 | 7 | 10.0 | 25.0 | 25.0 | 10.0 | 4.0 | 6.0 | 110 |
| 2 | 2 | 30.0 | 3 | 10.0 | 25.0 | 25.0 | 10.0 | 4.0 | 7.0 | 113 |
| 3 | 3 | 30.0 | 8 | 10.0 | 25.0 | 25.0 | 10.0 | 4.0 | 4.0 | 120 |
| 4 | 4 | 30.0 | 9 | 10.0 | 25.0 | 25.0 | 10.0 | 4.0 | 4.0 | 105 |
| 5 | 5 | 30.0 | 4 | 10.0 | 25.0 | 25.0 | 10.0 | 4.0 | 4.0 | 112 |
| 6 | 1 | 30.0 | 4 | 10.0 | 25.0 | 25.0 | 10.0 | 4.0 | 2.0 | 113 |
| 7 | 5 | 30.0 | 9 | 10.0 | 25.0 | 25.0 | 10.0 | 4.0 | 8.0 | 107 |
| 8 | 5 | 30.0 | 8 | 10.0 | 25.0 | 25.0 | 10.0 | 4.0 | 10.0 | 110 |
| 9 | 6 | 30.0 | 8 | 10.0 | 25.0 | 25.0 | 10.0 | 4.0 | 4.0 | 109 |
| 10 | 1 | 34.0 | 7 | 6.0 | 25.0 | 25.0 | 10.0 | 4.0 | 6.0 | 121 |
| 11 | 1 | 36.8 | 7 | 3.2 | 25.0 | 25.0 | 10.0 | 4.0 | 6.0 | 110 |
| 12 | 1 | 20.2 | 7 | 19.8 | 25.0 | 25.0 | 10.0 | 4.0 | 6.0 | 113 |
| 13 | 1 | 25.2 | 7 | 24.8 | 25.0 | 25.0 | 10.0 | 4.0 | 6.0 | 115 |
| 14 | 1 | 22.5 | 7 | 27.5 | 25.0 | 25.0 | 10.0 | 4.0 | 6.0 | 107 |
| 15 | 1 | 28.0 | 7 | 12.0 | 25.0 | 25.0 | 10.0 | 4.0 | 6.0 | 109 |
| 16 | 1 | 30.0 | 16 | 10.0 | 25.0 | 25.0 | 10.0 | 4.0 | 10.0 | 110 |
| 17 | 5 | 30.0 | 1 | 10.0 | 25.0 | 25.0 | 10.0 | 4.0 | 2.0 | 121 |
| 18 | 1 | 37.6 | 7 | 2.4 | 25.0 | 25.0 | 10.0 | 4.0 | 6.0 | 116 |
| 19 | — | — | 7 | 40.0 | 25.0 | 25.0 | 10.0 | 4.0 | — | 102 |
| 20 | 1 | 40.0 | — | — | 25.0 | 25.0 | 10.0 | 4.0 | — | 103 |

methacrylic-modified organopolysiloxane: X-22-2475 (Shin-Etsu Silicone)

long-chain crosslinking agent: APG-400 (Shin-Nakamura Chemical Co., Ltd.)

<Preparation of Shell Resin Dispersions 2 to 20>

Shell resin dispersions 2 to 20 were obtained proceeding entirely as in Preparation of Shell Resin Dispersion 1, but changing the type and amount charged of the starting materials used as shown in Table 3.

<Preparation of a Colorant Dispersion>

| | |
|---|---|
| C.I. Pigment Blue 15:3 | 100.0 parts |
| acetone | 150.0 parts |
| glass beads (1 mm) | 300.0 parts |

These materials were introduced into a heat-resistant glass vessel; dispersion was carried out for 5 hours with a paint shaker (Toyo Seiki Seisaku-sho Ltd.); and the glass beads were removed using a nylon mesh to obtain a colorant dispersion having a volume-average particle diameter of 200 nm and a solids content of 40.0 mass %.

<Preparation of a Wax Dispersion>

| | |
|---|---|
| dipentaerythritol palmitate ester wax | 16.0 parts |
| wax dispersant (copolymer with a peak molecular weight of 8,500 provided by the graft copolymerization of 50.0 parts of styrene, 25.0 parts of n-butyl acrylate, and 10.0 parts of acrylonitrile in the presence of 15.0 parts of polyethylene) | 8.0 parts |
| acetone | 76.0 parts |

The preceding were introduced into a glass beaker (IWAKI Glass) equipped with a stirring blade, and dissolution of the wax in the acetone was carried out by heating the system to 50° C.

The system was then gradually cooled while gently stirring at 50 rpm and was cooled to 25° C. over 3 hours to obtain a milky liquid.

This solution was introduced into a heat-resistant vessel along with 20 parts of 1 mm glass beads; dispersion was carried out for 3 hours with a paint shaker; and the glass beads were removed on a nylon mesh to obtain a wax dispersion having a volume-average particle diameter of 270 nm and a solids content of 24 mass %.

Example 1

(Production of Toner Particle 1)

| | |
|---|---|
| block polymer solution 1 | 200.0 parts |
| shell resin dispersion 1 | 100.0 parts |
| wax dispersion | 20.0 parts |
| colorant dispersion | 12.0 parts |

were introduced into a beaker and, after adjusting the temperature to 45.0° C., a resin composition 1 was obtained by stirring for 1 minute at 3,000 rpm using a Disper (Tokushu Kika Kogyo Co., Ltd.).

Using the apparatus shown in FIG. 1, the resin composition 1 was charged to the granulation tank t1, the temperature of the interior of which had been adjusted to 45.0° C. in advance; the valve V1 and the pressure-regulating valve V2 were closed; and the temperature of the resin composition 1 was adjusted to 45.0° C. while stirring the interior of the granulation tank t1 at a rotation rate of 300 rpm. The valve V1 was opened; carbon dioxide (purity=99.99%) was introduced into the granulation tank t1 from the compressed gas cylinder B1; and the valve V1 was closed when the pressure in the interior reached 2.0 MPa.

The mass of the introduced carbon dioxide was measured using a mass flow meter at 250.0 parts. The temperature within the vessel was confirmed to be 45.0° C., and granulation was performed by stirring for 10 minutes at a stirring rate of 1,000 rpm and a dispersion was prepared.

The stirring rate was then dropped to 300 rpm and the interior of the vessel was cooled to 23.0° C. at a ramp down rate of 0.5° C./min.

The valve V1 was then opened and carbon dioxide was introduced into the granulation tank t1 from the compressed gas cylinder B1 using the pump P1. At this point the pressure-regulating valve V2 was set to 8.0 MPa and carbon dioxide was additionally flowed through while maintaining the interior pressure of the granulation tank t1 at 8.0 MPa. Through this process, carbon dioxide containing organic solvent (primarily acetone) extracted from the droplets after granulation was discharged into the solvent recovery tank t2 and the organic solvent was separated from the carbon dioxide.

After 1 hour the pump P1 was stopped and the valve V1 was closed; the pressure-regulating valve V2 was opened a little at a time; and a toner particle 1, which was trapped by the filter, was recovered by reducing the pressure within the granulation tank t1 to atmospheric pressure.

(Toner 1 Production Step)

A toner 1 of the present invention was obtained by dry mixing, for 5 minutes using a Henschel mixer (Mitsui Mining Co., Ltd.), 1.8 parts of a hexamethyldisilazane-treated hydrophobic silica fine powder (number-average primary particle diameter=7 nm) and 0.15 parts of a rutile titanium oxide fine powder (number-average primary particle diameter=30 nm) with 100 parts of toner particle 1. The properties of the obtained toner and the properties of the individual materials used for the toner are given in Table 5.

TABLE 4

| | resin solution | | shell resin dispersion | | wax | colorant |
|---|---|---|---|---|---|---|
| | resin used | amount charged (mass parts) | resin used (shell resin dispersion No.) | amount charged (mass parts) | dispersion amount charged (mass parts) | dispersion amount charged (mass parts) |
| example 1 | block polymer solution 1 | 200.0 | 1 | 100.0 | 20.0 | 12.0 |
| example 2 | block polymer solution 2 | 200.0 | 2 | 100.0 | 20.0 | 12.0 |
| example 3 | block polymer solution 3 | 200.0 | 3 | 100.0 | 20.0 | 12.0 |
| example 4 | block polymer solution 4 | 200.0 | 4 | 100.0 | 20.0 | 12.0 |
| example 5 | block polymer solution 1 | 200.0 | 5 | 100.0 | 20.0 | 12.0 |
| example 6 | block polymer solution 1 | 200.0 | 6 | 100.0 | 20.0 | 12.0 |
| example 7 | block polymer solution 1 | 200.0 | 7 | 100.0 | 20.0 | 12.0 |
| example 8 | block polymer solution 1 | 200.0 | 8 | 100.0 | 20.0 | 12.0 |

TABLE 4-continued

| | resin solution | | shell resin dispersion | | wax | colorant |
|---|---|---|---|---|---|---|
| | resin used | amount charged (mass parts) | resin used (shell resin dispersion No.) | amount charged (mass parts) | dispersion amount charged (mass parts) | dispersion amount charged (mass parts) |
| example 9 | block polymer solution 2 | 200.0 | 9 | 100.0 | 20.0 | 12.0 |
| example 10 | block polymer solution 2 | 200.0 | 1 | 100.0 | 20.0 | 12.0 |
| example 11 | block polymer solution 1 | 200.0 | 2 | 100.0 | 20.0 | 12.0 |
| example 12 | block polymer solution 1 | 200.0 | 10 | 100.0 | 20.0 | 12.0 |
| example 13 | block polymer solution 1 | 200.0 | 11 | 100.0 | 20.0 | 12.0 |
| example 14 | block polymer solution 1 | 180.0 | 12 | 133.2 | 18.0 | 10.8 |
| example 15 | block polymer solution 1 | 180.0 | 13 | 133.2 | 18.0 | 10.8 |
| example 16 | block polymer solution 1 | 180.0 | 14 | 144.0 | 18.0 | 10.8 |
| example 17 | block polymer solution 1 | 220.0 | 15 | 55.0 | 22.0 | 13.2 |
| example 18 | block polymer solution 5 | 200.0 | 1 | 100.0 | 20.0 | 12.0 |
| example 19 | block polymer solution 6 | 200.0 | 1 | 100.0 | 20.0 | 12.0 |
| example 20 | crystalline polyester solution 1 | 140.0 | 1 | 100.0 | 20.0 | 12.0 |
| | amorphous resin solution 1 | 60.0 | | | | |
| comparative example 1 | block polymer solution 7 | 200.0 | 1 | 100.0 | 20.0 | 12.0 |
| comparative example 2 | block polymer solution 8 | 200.0 | 1 | 100.0 | 20.0 | 12.0 |
| comparative example 3 | block polymer solution 1 | 200.0 | 16 | 100.0 | 20.0 | 12.0 |
| comparative example 4 | block polymer solution 1 | 200.0 | 17 | 100.0 | 20.0 | 12.0 |
| comparative example 5 | block polymer solution 1 | 200.0 | 18 | 100.0 | 20.0 | 12.0 |
| comparative example 6 | block polymer solution 1 | 200.0 | 19 | 100.0 | 20.0 | 12.0 |
| comparative example 7 | block polymer solution 1 | 200.0 | 20 | 100.0 | 20.0 | 12.0 |
| comparative example 8 | block polymer solution 1 | 200.0 | 20 | 100.0 | 20.0 | 12.0 |
| comparative example 9 | amorphous resin solution 2 | 200.0 | 1 | 100.0 | 20.0 | 12.0 |

TABLE 5

| | | Tt (° C.) | $\Delta H_{Tt-3}/\Delta H$ | half width (° C.) | $TB_2$-$TB_1$ (° C.) | TA-$TB_1$ (° C.) | $TB_2$-TA (° C.) | T't-Tt (° C.) | content (mass parts) of resin B relative to binder resin (100 mass parts) | content (mass parts) of segment $b_2$ relative to binder resin (100 mass parts) | b2/(b1 + b2) (mass %) |
|---|---|---|---|---|---|---|---|---|---|---|---|
| Example 1 | toner 1 | 59.6 | 0.10 | 2.3 | 18.7 | −3.9 | 22.6 | 1.5 | 10.0 | 1.0 | 25.0 |
| Example 2 | toner 2 | 50.9 | 0.10 | 2.3 | 20.1 | −3.3 | 23.4 | 1.2 | 10.0 | 1.0 | 25.0 |
| Example 3 | toner 3 | 77.8 | 0.11 | 2.3 | 22.0 | 3.6 | 18.4 | 1.5 | 10.0 | 1.0 | 25.0 |
| Example 4 | toner 4 | 68.1 | 0.10 | 2.2 | 16.0 | −2.5 | 18.5 | 0.9 | 10.0 | 1.0 | 25.0 |
| Example 5 | toner 5 | 59.6 | 0.14 | 2.7 | 10.7 | −0.5 | 11.2 | 0.8 | 10.0 | 1.0 | 25.0 |
| Example 6 | toner 6 | 59.6 | 0.18 | 3.1 | 7.3 | −3.9 | 11.2 | 0.2 | 10.0 | 1.0 | 25.0 |
| Example 7 | toner 7 | 59.6 | 0.14 | 2.8 | 26.7 | −0.5 | 27.2 | 0.6 | 10.0 | 1.0 | 25.0 |
| Example 8 | toner 8 | 59.6 | 0.19 | 3.3 | 36.1 | −0.5 | 36.6 | 0.2 | 10.0 | 1.0 | 25.0 |
| Example 9 | toner 9 | 68.1 | 0.17 | 3.2 | 18.3 | −9.6 | 27.9 | 0.1 | 10.0 | 1.0 | 25.0 |
| Example 10 | toner 10 | 68.1 | 0.14 | 2.8 | 18.7 | 4.8 | 13.9 | 0.8 | 10.0 | 1.0 | 25.0 |
| Example 11 | toner 11 | 59.6 | 0.17 | 3.1 | 20.1 | 5.5 | 14.6 | 0.1 | 10.0 | 1.0 | 25.0 |
| Example 12 | toner 12 | 59.6 | 0.14 | 2.7 | 18.7 | −3.9 | 22.6 | 0.6 | 10.0 | 0.6 | 15.0 |
| Example 13 | toner 13 | 59.6 | 0.19 | 3.4 | 18.7 | −3.9 | 22.6 | 0.3 | 10.0 | 0.3 | 8.0 |
| Example 14 | toner 14 | 59.6 | 0.10 | 2.3 | 18.7 | −3.9 | 22.6 | 1.6 | 14.8 | 2.9 | 49.5 |
| Example 15 | toner 15 | 59.6 | 0.10 | 2.2 | 18.7 | −3.9 | 22.6 | 1.3 | 14.8 | 3.7 | 49.5 |
| Example 16 | toner 16 | 59.6 | 0.10 | 2.3 | 18.7 | −3.9 | 22.6 | 1.3 | 16.0 | 4.4 | 55.0 |
| Example 17 | toner 17 | 59.6 | 0.14 | 2.9 | 18.7 | −3.9 | 22.6 | 0.6 | 5.0 | 0.6 | 30.0 |
| Example 18 | toner 18 | 59.6 | 0.10 | 2.3 | 18.7 | −3.9 | 22.6 | 1.2 | 10.0 | 1.0 | 25.0 |
| Example 19 | toner 19 | 59.6 | 0.10 | 2.4 | 18.7 | −3.9 | 22.6 | 1.5 | 10.0 | 1.0 | 25.0 |
| Example 20 | toner 20 | 59.6 | 0.13 | 2.4 | 18.7 | −3.9 | 22.6 | 0.8 | 10.0 | 1.0 | 25.0 |
| Comparative Example 1 | comparative toner 1 | 48.5 | 0.10 | 2.3 | 20.1 | −5.2 | 25.3 | 1.5 | 10.0 | 1.0 | 25.0 |
| Comparative Example 2 | comparative toner 2 | 80.4 | 0.10 | 2.4 | 14.0 | −1.6 | 15.6 | 1.3 | 10.0 | 1.0 | 25.0 |
| Comparative Example 3 | comparative toner 3 | 59.6 | 0.22 | 4.4 | 42.1 | −3.9 | 46.0 | −0.3 | 10.0 | 1.0 | 25.0 |
| Comparative Example 4 | comparative toner 4 | 59.6 | 0.26 | 3.8 | 3.4 | −0.5 | 3.9 | −0.5 | 10.0 | 1.0 | 25.0 |

TABLE 5-continued

| | | Tt (° C.) | $\Delta H_{Tt-3}/\Delta H$ | half width (° C.) | $TB_2$-$TB_1$ (° C.) | TA-$TB_1$ (° C.) | $TB_2$-TA (° C.) | T't-Tt (° C.) | content (mass parts) of resin B relative to binder resin (100 mass parts) | content (mass parts) of segment $b_2$ relative to binder resin (100 mass parts) | b2/(b1 + b2) (mass %) |
|---|---|---|---|---|---|---|---|---|---|---|---|
| Comparative Example 5 | comparative toner 5 | 59.6 | 0.22 | 3.8 | 18.7 | −3.9 | 22.6 | −0.1 | 10.0 | 0.2 | 6.0 |
| Comparative Example 6 | comparative toner 6 | 59.6 | 0.29 | 5.1 | — | — | 22.6 | −0.8 | 10.0 | 4.0 | 100.0 |
| Comparative Example 7 | comparative toner 7 | 59.6 | 0.33 | 5.0 | — | −3.9 | — | −0.9 | 10.0 | — | — |
| Comparative Example 8 | comparative toner 8 | 61.1 | 0.33 | 5.0 | — | −3.9 | — | −3.1 | 10.0 | — | — |
| Comparative Example 9 | comparative toner 9 | — | — | — | 18.7 | — | — | — | 10.0 | 1.0 | 25.0 |

In the table, the half width refers to the half width of the endothermic peak $P_2$.

<Methods of Toner Evaluation>

(1) Low-Temperature Fixability

The low-temperature fixability was evaluated using an LBP5300 printer from Canon, Inc. The LBP5300 uses mono-component contact development and controls the amount of toner on the developer bearing member using a toner control member. The cartridge used in the evaluation was obtained by removing the toner present in a cartridge for the LBP5300, cleaning the interior with an air blower, and filling with the toner that had been obtained. This cartridge was held in a normal-temperature, normal-humidity environment (temperature 23° C./humidity 60% RH) for 24 hours and was then installed in the cyan station of the LBP5300, while dummy cartridges were installed otherwise. An unfixed toner image (toner laid-on amount per unit area=0.6 mg/cm$^2$, 30 mm upper margin, 15 mm lower margin, 10 mm left and right margins) was subsequently formed on general-purpose copy paper (81.4 g/m$^2$).

The fixing unit of the printer was modified to enable the fixation temperature to be manually set, and the rotation speed of the fixing unit was changed to 265 mm/s and the nip internal pressure was changed to 98 kPa. Using this modified fixing unit, fixed images were obtained from the unfixed images at each individual temperature in a normal-temperature, normal-humidity environment while raising the fixation temperature in 5° C. increments in the range from 100° C. to 150° C.

The image area of the obtained fixed image was overlaid with pliable thin paper (for example, product name "Dusper", Ozu Corporation), and the image area was rubbed 5 times back-and-forth while a load of 4.9 kPa was applied on the thin paper. The image density was measured before rubbing and after rubbing, and the decline $\Delta D_1$(%) in the image density was calculated using the formula given below. The temperature when this $\Delta D_1$(%) was less than 10% was taken to be the fixing onset temperature and was used as the index for evaluating the low-temperature fixability. The image density was measured using a color reflection densitometer (X-Rite 404A Color Reflection Densitometer from X-Rite, Incorporated). The results of the evaluation are given in Table 6.

$$\Delta D_1(\%)=\{(\text{image density before rubbing}-\text{image density after rubbing})/\text{image density before rubbing}\}\times 100$$

[Evaluation Criteria]

A: the fixing onset temperature is less than 110° C.

B: the fixing onset temperature is 110° C. or more and less than 120° C.

C: the fixing onset temperature is 120° C. or more and less than 130° C.

D: the fixing onset temperature is 130° C. or more (2) Stability of the Fixed Image in Severe Environments The stability of the fixed image in severe environments was evaluated by changing the toner laid-on amount per unit area in the aforementioned evaluation of the low-temperature fixability to 0.8 mg/cm$^2$ and using the fixed image provided by fixing at a temperature 20° C. higher than the fixing onset temperature. 600 prints of the fixed image were stacked followed by storage for 3 days or 30 days in a high-temperature environment (temperature=57° C.) This was followed by standing for 24 hours in a normal-temperature, normal-humidity environment, and the 500th print from the top was then peeled from the 501st print to evaluate the stability of the fixed image in severe environments. The results of the evaluation are given in Table 6.

A: the paper separates smoothly without resistance

B: some popping sound is heard, but there is almost no resistance

C: a popping sound is heard during peeling, but no image transfer occurs

D: some image transfer to the opposing paper occurs

F: substantial image transfer occurs to the opposing paper, or the paper cannot be peeled

TABLE 6

| | low-temperature fixability | | stability of fixed image in severe environments | |
|---|---|---|---|---|
| | fixing onset temperature (° C.) | evaluation | 57° C./3 days | 57° C./30 days |
| Example 1 | 100 | A | A | A |
| Example 2 | 100 | A | B | C |
| Example 3 | 125 | C | A | A |
| Example 4 | 105 | A | A | A |
| Example 5 | 100 | A | A | B |
| Example 6 | 100 | A | A | C |
| Example 7 | 100 | A | A | B |
| Example 8 | 100 | A | B | C |
| Example 9 | 105 | A | A | C |
| Example 10 | 105 | A | A | B |
| Example 11 | 100 | A | A | C |
| Example 12 | 100 | A | A | B |
| Example 13 | 100 | A | B | C |
| Example 14 | 105 | A | A | A |
| Example 15 | 110 | B | A | A |
| Example 16 | 115 | B | A | A |
| Example 17 | 100 | A | A | B |
| Example 18 | 115 | B | A | A |

TABLE 6-continued

| | low-temperature fixability | | stability of fixed image in severe environments | |
|---|---|---|---|---|
| | fixing onset temperature (° C.) | evaluation | 57° C./3 days | 57° C./30 days |
| Example 19 | 100 | A | A | B |
| Example 20 | 100 | A | A | B |
| Comparative Example 1 | 100 | A | B | D |
| Comparative Example 2 | 135 | D | A | A |
| Comparative Example 3 | 110 | B | B | D |
| Comparative Example 4 | 100 | A | B | D |
| Comparative Example 5 | 100 | A | B | D |
| Comparative Example 6 | 100 | A | B | D |
| Comparative Example 7 | 100 | A | B | D |
| Comparative Example 8 | 100 | A | A | D |
| Comparative Example 9 | 125 | C | E | E |

Examples 2 to 20

Toner particles 2 to 20 were obtained proceeding as in Example 1, but changing the type and amount of addition of the resins used in Example 1 as shown in Table 4. Toners 2 to 20 were also obtained proceeding as in Example 1. The properties of the obtained toners and the properties of the toner materials are given in Table 5. The same evaluations as in Example 1 were performed and these results are given in Table 6.

Comparative Examples 1 to 7 and 9

Comparative toner particles 1 to 7 and 9 were obtained proceeding as in Example 1, but changing the type and amount of addition of the resins used in Example 1 as shown in Table 4. Comparative toners 1 to 7 and 9 were also obtained proceeding as in Example 1. The properties of the obtained comparative toners and the properties of the toner materials are given in Table 5. The same evaluations as in Example 1 were performed and these results are given in Table 6.

Comparative Example 8

An annealing treatment was performed on the comparative toner particle 7 obtained in Comparative Example 7.

The annealing treatment was performed using a constant-temperature dryer (41-S5 from Satake Chemical Equipment Mfg. Ltd.). The internal temperature of the constant-temperature dryer was adjusted to 52.0° C.

The comparative toner particle 7 was introduced spread out evenly into a stainless steel vat, and this was placed in the constant-temperature dryer and then held at quiescence for 12 hours and removed. An annealed toner particle 8 was obtained proceeding in this manner.

A comparative toner 8 was obtained proceeding as in Example 1 with this toner particle 8. The properties of the obtained comparative toner 8 and the properties of the toner materials are given in Table 5. The same evaluations as in Example 1 were performed and these results are given in Table 6.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-062986, filed Mar. 25, 2015, which is hereby incorporated by reference herein in its entirety.

What is claimed is:

1. A toner comprising a toner particle having a core-shell structure comprising a core and a shell phase on a surface of the core;

the core comprising a binder resin, comprising a crystalline resin A; and the shell phase comprises a resin B comprising in one molecule a segment $b_1$ originating from a crystalline resin $B_1$ and a segment $b_2$ originating from a crystalline resin $B_2$, wherein the toner satisfies formulae (1) and (2) when measured with a differential scanning (DSC)

$$50.0 \leq Tt \leq 80.0 \quad (1)$$

$$0.00 \leq \Delta H_{T't-3}/\Delta H \leq 0.20 \quad (2)$$

where Tt (° C.) represents a peak temperature of an endothermic peak $P_1$ originating from the crystalline resin A during a first temperature ramp up process, ΔH (J/g) represents an endothermic quantity originating from the crystalline resin A from a temperature 20.0° C. lower than T't to a temperature 10.0° C. higher than T't when T't (° C.) is a peak temperature of an endothermic peak $P_2$ originating from the crystalline resin A during a second temperature ramp up process, and $\Delta H_{T't-3}$(J/g) represents an endothermic quantity originating from the crystalline resin A from a temperature lower 20.0° C. than T't to a temperature 3.0° C. lower than T't , and the binder resin, the crystalline resin $B_1$. and the crystalline resin $B_2$ satisfy formulae (4) and (5), $$10.0 \leq TB_2 - TA \leq 30.0 \quad (4)$$

$$-5.0 \leq TA - TB_1 \leq 5.0 \quad (5)$$

where TA (° C.) represents a peak temperature of an endothermic peak originating from the crystalline resin A during a first temperature ramp up process in measurement of the binder resin with a DSC, $TB_1$(° C.) represents a peak temperature of an endothermic peak during a first temperature ramp up process in measurement of the crystalline resin $B_1$ with a DSC, and $TB_2$ (° C.) represents a peak temperature of an endothermic peak during a first temperature ramp up process in measurement of the crystalline resin $B_2$ with a DSC).

2. The toner according to claim 1, wherein ΔH and $\Delta H_{T't-3}$ satisfy $0.00 \leq \Delta H_{T't-3}/\Delta H \leq 0.15$.

3. The toner according to claim 1, wherein half width of the endothermic peak $P_2$ in the DSC measurement of the toner is not more than 3.0° C .

4. The toner according claim 1, wherein $TB_1$ and $TB_2$ satisfy $5.0 \leq TB_2 - TB_1 \leq 35.0$.

5. The toner according to claim 1, wherein the content of the segment $b_2$ originating from the crystalline resin $B_2$ in the resin B is from 0.5 to 4.0 mass parts per 100 mass parts of the binder resin, and the content of the segment $b_2$ originating from the crystalline resin $B_2$ in the resin B is from 10.0 to50.0 mass % with respect to the total of the segment $b_1$ originating from the crystalline resin $B_1$and the segment $b_2$ originating from the crystalline resin $B_2$.

6. The toner according to claim 1, wherein the crystalline resin $B_1$ and the crystalline resin $B_2$ comprise a crystalline polyester resin comprising:

a unit derived from a linear chain aliphatic diol; and a unit derived from a linear chain aliphatic dicarboxylic acid; and the crystalline resin $B_1$ and the crystalline resin $B_2$ satisfy $Cb_2 - Cb_1 \geq 2.0$ where $Cb_1$ represents the total of the number of carbons in the linear chain aliphatic diol of the crystalline resin $B_1$and the number of carbons in the linear chain aliphatic dicarboxylic acid of the crystalline resin $B_1$, and $Cb_2$ represents the total of the number of carbons in the linear chain aliphatic diol of the crystalline resin $B_2$ and the number of carbons in the linear chain aliphatic dicarboxylic acid of the crystalline resin $B_2$.

7. The toner according to, claim 1, wherein the content of the resin B in the toner particle is from 3.0 to 15.0 mass parts per 100 mass parts of the binder resin.

8. The toner according to claim 1, wherein the crystalline resin A comprises a unit derived from a $C_{3-10}$ linear chain aliphatic diol and a unit derived from a $C_{6-14}$ linear chain aliphatic dicarboxylic acid.

9. The toner according to claim 8, wherein the content of the crystalline resin A with respect to the binder resin is from 50.0 to 90.0 mass %.

10. The toner according to claim 8, wherein the binder resin contains a block polymer in which the crystalline resin A is chemically bonded with an amorphous resin.

11. The toner according to claim 1, wherein Tt and T't satisfy $0.0 \leq T't - Tt \leq 5.0$.

* * * * *